US008795936B2

(12) United States Patent
Sekido et al.

(10) Patent No.: US 8,795,936 B2
(45) Date of Patent: Aug. 5, 2014

(54) ELECTROPHOTOGRAPHIC PHOTOSENSITIVE MEMBER, PROCESS CARTRIDGE, AND ELECTROPHOTOGRAPHIC APPARATUS

(75) Inventors: Kunihiko Sekido, Suntou-gun (JP); Michiyo Sekiya, Mishima (JP); Akihiro Maruyama, Mishima (JP); Shinji Takagi, Yokohama (JP); Hideaki Nagasaka, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 110 days.

(21) Appl. No.: 13/510,612

(22) PCT Filed: Jun. 24, 2011

(86) PCT No.: PCT/JP2011/065124

§ 371 (c)(1),
(2), (4) Date: May 17, 2012

(87) PCT Pub. No.: WO2012/002516

PCT Pub. Date: Jan. 5, 2012

(65) Prior Publication Data

US 2012/0230727 A1 Sep. 13, 2012

(30) Foreign Application Priority Data

Jun. 29, 2010 (JP) ..... 2010-147351
Jun. 21, 2011 (JP) ..... 2011-137511

(51) Int. Cl.
*G03G 15/04* (2006.01)
*G03G 15/00* (2006.01)

(52) U.S. Cl.
USPC ..... 430/66; 430/69; 399/96; 399/111

(58) Field of Classification Search
USPC ..... 430/60, 69; 399/96, 111
See application file for complete search history.

(56) References Cited

U.S. PATENT DOCUMENTS

| | | | |
|---|---|---|---|
| 4,442,193 | A | 4/1984 | Chen et al. |
| 4,562,132 | A | 12/1985 | Ong et al. |
| 4,882,257 | A | 11/1989 | Maruyama et al. |
| 4,892,800 | A | 1/1990 | Sugata et al. |
| 4,992,349 | A | 2/1991 | Chen et al. |
| 5,176,976 | A | 1/1993 | Kikuchi et al. |
| 5,352,552 | A | 10/1994 | Maruyama et al. |

(Continued)

FOREIGN PATENT DOCUMENTS

| | | | |
|---|---|---|---|
| CN | 101004561 | A | 7/2007 |
| JP | 1-206349 | A | 8/1989 |

(Continued)

OTHER PUBLICATIONS

PCT International Search Report and Written Opinion of the International Searching Authority, International Application No. PCT/JP2011/065124, Mailing Date Aug. 23, 2011.

(Continued)

*Primary Examiner* — Thorl Chea
(74) *Attorney, Agent, or Firm* — Fitzpatrick, Cella, Harper and Scinto

(57) ABSTRACT

An undercoat layer of an electrophotographic photosensitive member contains a polymer having a specific repeating structural unit in order to provide an electrophotographic photosensitive member that suppresses positive ghost, and a process cartridge and an electrophotographic apparatus having the electrophotographic photosensitive member.

4 Claims, 1 Drawing Sheet

(56) References Cited

U.S. PATENT DOCUMENTS

| | | | |
|---|---|---|---|
| 5,385,797 | A | 1/1995 | Nagahara et al. |
| 5,391,446 | A | 2/1995 | Ohtani et al. |
| 5,391,449 | A | 2/1995 | Maruyama et al. |
| 5,422,210 | A | 6/1995 | Maruyama et al. |
| 5,455,135 | A | 10/1995 | Maruyama et al. |
| 5,468,583 | A | 11/1995 | Gruenbaum et al. |
| 5,484,673 | A | 1/1996 | Kikuchi et al. |
| 5,604,061 | A | 2/1997 | Sekido et al. |
| 5,667,926 | A | 9/1997 | Maruyama et al. |
| 5,677,095 | A | 10/1997 | Kikuchi et al. |
| 5,693,443 | A | 12/1997 | Nakamura et al. |
| 5,729,801 | A | 3/1998 | Maruyama et al. |
| 5,890,037 | A | 3/1999 | Kukimoto et al. |
| 5,923,925 | A | 7/1999 | Nakamura et al. |
| 6,016,414 | A | 1/2000 | Anayama et al. |
| 6,110,628 | A | 8/2000 | Sekiya et al. |
| 6,180,303 | B1 | 1/2001 | Uematsu et al. |
| 6,228,546 | B1 | 5/2001 | Kashizaki et al. |
| 6,248,490 | B1 | 6/2001 | Suzuki et al. |
| 6,335,133 | B1 | 1/2002 | Nagasaka |
| 6,372,397 | B1 | 4/2002 | Maruyama et al. |
| 6,416,915 | B1 | 7/2002 | Kikuchi et al. |
| 6,432,603 | B1 | 8/2002 | Kimura et al. |
| 6,436,597 | B2 | 8/2002 | Maruyama et al. |
| 6,664,014 | B1 | 12/2003 | Kikuchi et al. |
| 6,953,647 | B2 | 10/2005 | Kimura et al. |
| 7,141,341 | B2 | 11/2006 | Sekido et al. |
| 7,186,489 | B2 | 3/2007 | Uematsu et al. |
| 7,226,711 | B2 | 6/2007 | Amamiya et al. |
| 7,378,205 | B2 | 5/2008 | Sekiya et al. |
| 7,534,534 | B2 | 5/2009 | Nakata et al. |
| 7,541,124 | B2 | 6/2009 | Molaire et al. |
| 7,551,878 | B2 | 6/2009 | Ogaki et al. |
| 7,556,901 | B2 | 7/2009 | Anezaki et al. |
| 7,563,553 | B2 | 7/2009 | Kikuchi et al. |
| 7,622,238 | B2 | 11/2009 | Uematsu et al. |
| 7,718,331 | B2 | 5/2010 | Uematsu et al. |
| 7,732,113 | B2 | 6/2010 | Nakamura et al. |
| 7,749,667 | B2 | 7/2010 | Kawahara et al. |
| 8,007,972 | B2 | 8/2011 | Kurimoto et al. |
| 2005/0031977 | A1 * | 2/2005 | Kim et al. ..... 430/60 |
| 2007/0042282 | A1 | 2/2007 | Molaire et al. |
| 2011/0104597 | A1 | 5/2011 | Nagasaka et al. |
| 2011/0104601 | A1 | 5/2011 | Takagi et al. |
| 2011/0143273 | A1 | 6/2011 | Sekido et al. |
| 2011/0268472 | A1 | 11/2011 | Sekido et al. |
| 2012/0052423 | A1 | 3/2012 | Maruyama et al. |

FOREIGN PATENT DOCUMENTS

| | | | |
|---|---|---|---|
| JP | 5-279582 | A | 10/1993 |
| JP | 7-70038 | A | 3/1995 |
| JP | 2001-83726 | A | 3/2001 |
| JP | 2003-345044 | A | 12/2003 |
| JP | 2004-93809 | A | 3/2004 |
| JP | 2005-23322 | A | 1/2005 |
| JP | 2006-251487 | A | 9/2006 |
| JP | 2007-179031 | A | 7/2007 |
| JP | 2009-505156 | A | 2/2009 |
| JP | 2010-198014 | A | 9/2010 |

OTHER PUBLICATIONS

"The Foundation and Application of Polyurethane", CMC Publishing Co., Ltd., 1986, p. 3 (with partial translation).

"The Synthesis and Reaction of High Polymers (2)", Kyoritu Shuppan Co., Ltd., 1991, p. 326 (with partial translation).

Nicolaou, et al., "Palladium-Catalyzed Cross-Coupling Reactions in Total Synthesis", Angewandte Chemie Int. Ed. 2005, vol. 44, pp. 4442-4489.

Jones, et al., "Cyanonaphthalene Diimide Semiconductors for Air-Stable, Flexible, and Optically Transparent n-Channel Field-Effect Transistors", Chemistry of Materials, vol. 19, No. 11, May 29, 2007, pp. 2703-2705.

Jones, et al., "Tuning Orbital Energetics in Arylene Diimide Semiconductors. Materials Design for Ambient Stability of n-Type Charge Transport", J. Am. Chem. Soc., vol. 129, 2007, pp. 15259-15278.

Yamada, et al., "Synthesis and Properties of Diamino-Substituted Dipyrido [3,2-a: 2',3'-c]phenazine", Bulletin of the Chemical Society of Japan, vol. 65, No. 4, 1992, pp. 1006-1011.

Callahan, et al., "Syntheses of Phencyclone Analogues. Applications for NMR Studies of Hindered Rotations and Magnetic Anisotropy in Crowded Diels-Alder Adducts", Chem. Educator, vol. 6, 2001, pp. 227-234.

Kato, et al., "Nitration of Phenanthrenequinone", Journal of Synthetic Organic Chemistry, Japan, vol. 15, 1957, pp. 29-32.

Kato, et al., "Syntheses of Amino-phenanthrenequinones by the Reduction of Nitro Compounds", Journal of Synthetic Organic Chemistry, Japan, vol. 15, 1957, pp. 32-34.

Qian, et al., "4-Amino-1, 8-dicyanonaphthalene derivatives as novel fluorophore and fluorescence switches: efficient synthesis and fluorescence enhancement induced by transition metal ions and protons", Tetrahedron Letters, vol. 43, 2002, pp. 2991-2994.

Xiao, et al., "Novel highly efficient fluoroionophores with a peri-effect and strong electron-donating receptors: TICT-promoted PET and signaling response to transition metal cations with low background emission", Tetrahedron Letters, vol. 44, 2003, pp. 2087-2091.

Bolitt, et al., "A Convenient Synthesis of Pyrido[3,4-g]isoquinoline via ortho-Directed Metallation/Dimerization", Synthesis, vol. 5, 1988, pp. 388-389.

Okada, et al., "Synthesis and Properties of a Novel Electron Transporting Compound, 3, 3'-dialky1-4,4'- bisnaphthylquinone (DBNQ)", PPCl/Japan Hardcopy '98 Papers, 1998, pp. 207-210.

Ninomiya, et al., Phosphorus in Organic Synthesis-VII Diphenyl Phosphorazidate (DPPA). A New Convenient Reagent for a Modified Curtius Reaction, Tetrahedron, vol. 30, 1974, pp. 2151-2157.

Chinese Office Action dated May 5, 2014 in Chinese Application No. 201180032350.0.

* cited by examiner

ELECTROPHOTOGRAPHIC PHOTOSENSITIVE MEMBER, PROCESS CARTRIDGE, AND ELECTROPHOTOGRAPHIC APPARATUS

TECHNICAL FIELD

The present invention relates to an electrophotographic photosensitive member, and a process cartridge and an electrophotographic apparatus having an electrophotographic photosensitive member.

BACKGROUND ART

Among electrophotographic photosensitive members, since those using an organic photoconductive material have good film formability and can be produced by coating, these have an advantage of being capable of providing electrophotographic photosensitive members having a high productivity and a low price.

Although electrophotographic photosensitive members are broadly classified into positively charging ones and negatively charging ones depending on polarities of charges when their surfaces are charged, in the case of electrophotographic photosensitive members using an organic photoconductive material, more thereof are negatively charging electrophotographic photosensitive members.

Although electrophotographic photosensitive members generally have a support and a photosensitive layer formed on the support, for a photosensitive layer of a negatively charging electrophotographic photosensitive member, a photosensitive layer containing a charge generation material and a hole transport material (hereinafter, also referred to simply as "photosensitive layer") is used. The photosensitive layer containing a charge generation material and a hole transport material includes a photosensitive layer in which a charge generation layer containing a charge generation material and a hole transport layer containing a hole transport material are provided in this order from the support, and a photosensitive layer in which a charge generation material and a hole transport material are contained in the same layer.

If a photosensitive layer (charge generation layer) is provided directly on the support, exfoliation of the photosensitive layer (charge generation layer) is generated and defects (shape defects such as flaws or material defects such as impurities) on the surface of the support are reflected on images as they are, and image defects such as black spots and blank areas are generated in some cases.

In order to solve these problems, in many electrophotographic photosensitive members, a layer called an undercoat layer (also called an intermediate layer) is provided between the photosensitive layer and support.

However, deteriorations of characteristics of an electrophotographic photosensitive member, considered to be caused by the undercoat layer, are observed in some cases.

Then, attempts have conventionally been made to improve characteristics of the undercoat layer by making an electron transport material contained in the undercoat layer (Patent Literatures 1 and 2) to convert the undercoat layer to an electron transport layer.

CITATION LIST

Patent Literature

PTL 1: Japanese Patent Application Laid-Open No. 2001-83726

PTL 2: Japanese Patent Application Laid-Open No. 2003-345044

SUMMARY OF INVENTION

Technical Problem

In recent years, the demands on the quality of electrophotographic images have been increase steadily. For example, the acceptable range for positive ghost has been made strict markedly. The positive ghost refers to, in the case where an area irradiated with light turns to a halftone image on the subsequent rotation of an electrophotographic photosensitive member in the course of forming an image on one sheet of paper, a phenomenon in which only the area irradiated with light becomes high in the density.

With respect to suppression (reduction) of the positive ghost, the conventional techniques described above still have room for improvement.

It is an object of the present invention to provide an electrophotographic photosensitive member with suppressed positive ghost, and a process cartridge and an electrophotographic apparatus having the electrophotographic photosensitive member.

Solution to Problem

As a result of exhaustive studies, the present inventors have found that making a polymer having a specific structure contained in the undercoat layer of an electrophotographic photosensitive member allows the achievement of suppression of the positive ghost at a higher level.

That is, the present invention provides an electrophotographic photosensitive member having a support, an undercoat layer formed on the support, and a photosensitive layer formed on the undercoat layer and containing a charge generation material and a hole transport material, wherein the undercoat layer includes a polymer having a repeating structural unit represented by the following formula (1) with the proviso that a polymer further having a repeating structural unit represented by the following formula (2) is excluded from the polymer having the repeating structural unit represented by the following formula (1):

[Formula 1]

$$\text{-}(\text{-}Z^1\text{-}A^1\text{-}Z^2\text{-}W^1\text{-}B^1\text{-}W^2\text{-})\text{-} \quad (1)$$

$$\text{-}(\text{-}Z^3\text{-}A^2\text{-}Z^4\text{-}W^3\text{-}B^2\text{-}W^4\text{-})\text{-} \quad (2)$$

Wherein, in the formulae (1) and (2), $Z^1$ to $Z^4$ each independently represents a single bond, an alkylene group, an arylene group, an arylene group substituted with an alkyl group, or an aralkylene group; $W^1$ to $W^4$ each independently represents a single bond, a urethane bond, or a urea bond; $B^1$ represents an arylene group substituted with a carboxyl group or a sulfo group, an arylene group substituted with a carboxyl group and an alkyl group, or an alkylene group substituted with a carboxyl group or a sulfo group; $B^2$ represents an arylene group, an alkylene group, an aralkylene group, an arylene group substituted with an alkyl group, a halogen atom, a cyano group or a nitro group, an alkylene group substituted with a halogen atom, a cyano group or a nitro group, an aralkylene group substituted with an alkyl group, a halogen atom, a cyano group or a nitro group, an arylene group interrupted by ether or sulfonyl, or an alkylene group interrupted by ether; and $A^1$ and $A^2$ each independently represents a divalent group represented by any of the following formulae (A-1) to (A-8):

[Formula 2]

(A-1)

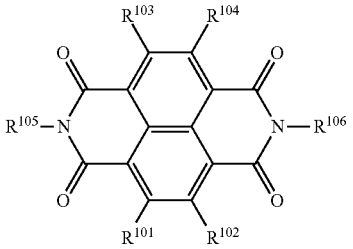

(A-2)

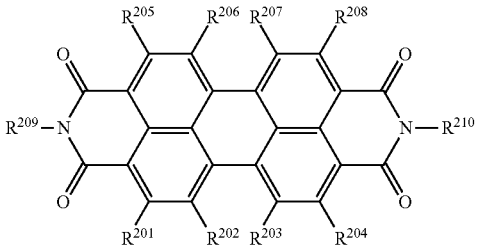

(A-3)

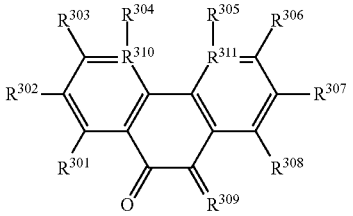

(A-4)

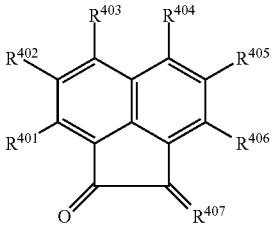

(A-5)

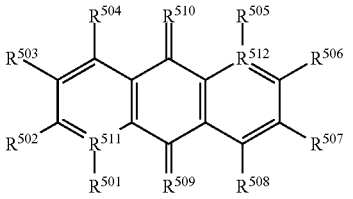

(A-6)

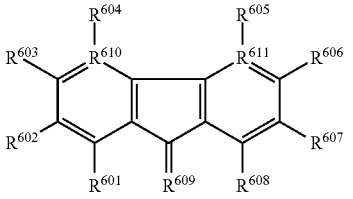

-continued (A-7)

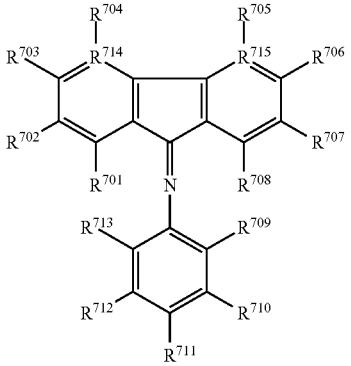

(A-8)

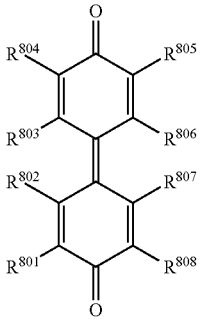

wherein, in the formula (A-1), $R^{101}$ to $R^{104}$ each independently represents a hydrogen atom, an aryl group, an aryl group substituted with a halogen atom, a nitro group, a cyano group, an alkyl group or a halogenated alkyl group, an alkyl group, a cyano group, or a bonding site; and $R^{105}$ and $R^{106}$ each independently represents an aryl group, an aryl group substituted with an alkyl group or a halogen atom, an alkyl group, or a bonding site; provided that two of $R^{101}$ to $R^{106}$ are each a bonding site;

in the formula (A-2), $R^{201}$ to $R^{208}$ each independently represents a hydrogen atom, an aryl group, an aryl group substituted with a halogen atom, a nitro group, a cyano group, an alkyl group or a halogenated alkyl group, an alkyl group, a cyano group, or a bonding site; and $R^{209}$ and $R^{210}$ each independently represents a hydrogen atom, an aryl group, an aryl group substituted with an alkyl group or a halogen atom, an alkyl group, or a bonding site; provided that two of $R^{201}$ to $R^{210}$ are each a bonding site;

in the formula (A-3), $R^{301}$ to $R^{308}$ each independently represents a hydrogen atom, an aryl group, an aryl group substituted with a halogen atom, a nitro group, a cyano group, an alkyl group or a halogenated alkyl group, an alkyl group, a cyano group, a nitro group, or a bonding site; $R^{309}$ represents an oxygen atom, or a dicyanomethylene group; $R^{310}$ and $R^{311}$ each independently represents a carbon atom, or a nitrogen atom; in the case where $R^{310}$ is a nitrogen atom, $R^{304}$ is not present, and in the case where $R^{311}$ is a nitrogen atom, $R^{305}$ is not present; provided that two of $R^{301}$ to $R^{308}$ are each a bonding site;

in the formula (A-4), $R^{401}$ to $R^{406}$ each independently represents a hydrogen atom, an aryl group, an aryl group substituted with a halogen atom, a nitro group, a cyano group, an alkyl group or a halogenated alkyl group, an alkyl group, a cyano group, a nitro group, or a bonding site; and $R^{407}$ represents an oxygen atom, or a dicyanomethylene group; provided that two of $R^{401}$ to $R^{406}$ are each a bonding site;

in the formula (A-5), $R^{501}$ to $R^{508}$ each independently represents a hydrogen atom, an aryl group, an aryl group substituted with a halogen atom, a nitro group, a cyano group, an alkyl group or a halogenated alkyl group, an alkyl group, a cyano group, a nitro group, or a bonding site; $R^{509}$ and $R^{510}$ each independently represents an oxygen atom, or a dicyanomethylene group; $R^{511}$ and $R^{512}$ each independently represents a carbon atom, or a nitrogen atom; in the case where $R^{511}$ is a nitrogen atom, $R^{501}$ is not present, and in the case where $R^{512}$ is a nitrogen atom, $R^{505}$ is not present; provided that two of $R^{501}$ to $R^{508}$ are each a bonding site;

in the formula (A-6), $R^{601}$ to $R^{608}$ each independently represents a hydrogen atom, an aryl group, an aryl group substituted with a halogen atom, a nitro group, a cyano group, an alkyl group or a halogenated alkyl group, an alkyl group, a cyano group, a nitro group, a carboxylate ester group, or a bonding site; $R^{610}$ and $R^{611}$ each independently represents a carbon atom, or a nitrogen atom; in the case where $R^{610}$ is a nitrogen atom, $R^{604}$ is not present, and in the case where $R^{611}$ is a nitrogen atom, $R^{605}$ is not present; and $R^{609}$ represents a dicyanomethylene group; provided that two of $R^{601}$ to $R^{608}$ are each a bonding site;

in the formula (A-7), $R^{701}$ to $R^{713}$ each independently represents a hydrogen atom, an aryl group, an aryl group substituted with a halogen atom, a nitro group, a cyano group, an alkyl group or a halogenated alkyl group, an alkyl group, a cyano group, a nitro group, a carboxylate ester group, or a bonding site; $R^{714}$ and $R^{715}$ each independently represents a carbon atom, or a nitrogen atom; in the case where $R^{714}$ is a nitrogen atom, $R^{704}$ is not present, and in the case where $R^{715}$ is a nitrogen atom, $R^{705}$ is not present; provided that two of $R^{701}$ to $R^{713}$ are each a bonding site; and in the formula (A-8), $R^{801}$ to $R^{808}$ each independently represents a hydrogen atom, an aryl group, an aryl group substituted with a halogen atom, a nitro group, a cyano group, an alkyl group or a halogenated alkyl group, an alkyl group, a cyano group, a nitro group, or a bonding site; provided that two of $R^{801}$ to $R^{808}$ are each a bonding site.

Examples of the halogen atom include a fluorine atom, a chlorine atom, and a bromine atom. Examples of the alkyl group include a methyl group, an ethyl group, a propyl group, and a butyl group. Examples of the halogenated alkyl group include a trifluoromethyl group. Examples of the aryl group include a phenyl group, a naphthyl group, and a biphenylyl group. Examples of the alkylene group include a methylene group, an ethylene group, a propylene group, and a butylene group. Examples of the arylene group include a phenylene group, a naphthylene group, and a biphenylylene group. The aralkylene group (also called an alkarylene group) means a divalent group made by combining an alkylene group and an arylene group, and examples thereof include groups made by combining a methylene group, an ethylene group, a propylene group or a butylene group with a phenylene group, a naphthylene group or a biphenylylene group.

The present invention also provides a process cartridge characterized in that the electrophotographic photosensitive member and at least one device selected from the group consisting of a charging device, a developing device, a transfer device and a cleaning device are supported integrally, and detachably mountable to a main body of an electrophotographic apparatus.

The present invention further provides an electrophotographic apparatus characterized by having the electrophotographic photosensitive member, and a charging device, an exposure device, a developing device and a transfer device.

Advantageous Effects of Invention

The present invention can provide an electrophotographic photosensitive member with suppressed positive ghost, and a process cartridge and an electrophotographic apparatus having the electrophotographic photosensitive member.

Concerning the reason that an electrophotographic photosensitive member having an undercoat layer containing a polymer having a repeating structural unit represented by the formula (1) shown above has an excellent effect of suppressing the positive ghost, the present inventors presume as follows.

That is, the polymer having a repeating structural unit represented by the formula (1) shown above is a polymer having a structure in which a site or moiety ($-Z^1-A^1-Z^2-$, especially $A^1$) having electron transportability and a site or moiety ($-W^1-B^1-W^2-$, especially $B^1$) having no electron transportability and containing carboxyl groups or sulfo groups are alternately present. In such a polymer, structures having electron transportability are not relatively unevenly distributed. The interaction between the carboxyl groups or the sulfo groups permits the structure with electron transportability to be adequately arranged in an undercoat layer containing the polymer. The present inventors presume that this structure can provide an excellent effect of suppressing the positive ghost.

Further features of the present invention will become apparent from the following description of exemplary embodiments with reference to the attached drawings.

DESCRIPTION OF EMBODIMENTS

Figure 1:
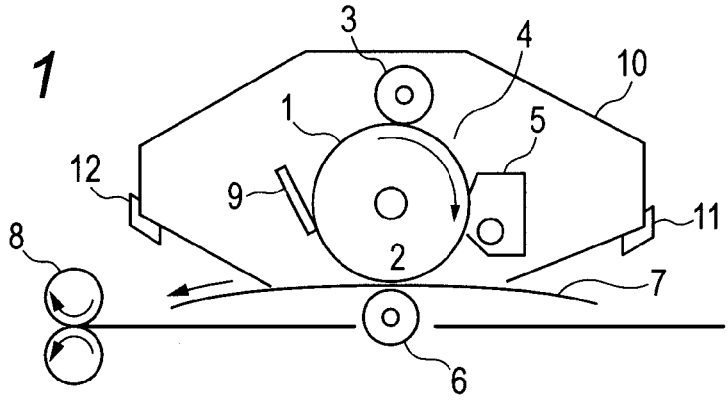
FIG. 1 is a diagram illustrating a schematic structure of an electrophotographic apparatus having a process cartridge equipped with the electrophotographic photosensitive member according to the present invention.

The electrophotographic photosensitive member according to the present invention has a support, an undercoat layer formed on the support, and a photosensitive layer formed on the undercoat layer and containing a charge generation material and a hole transport material.

[Support]

The support is desirably one having conductivity (conductive support), and examples thereof include a support made of a metal or alloy such as aluminum, nickel, copper, gold and iron, and a support in which a thin film of a metal such as aluminum, silver and gold, or a conductive material such as indium oxide and a tin oxide is formed on an insulating support such as of polyester, polycarbonate, polyimide or glass.

The surface of the support, in order to improve the electric characteristics and suppress interference fringes liable to be generated on irradiation of coherent light such as semiconductor laser light, may be subjected to an electrochemical treatment such as anodic oxidation, and treatments such as wet honing, blasting and cutting.

[Undercoat Layer]

In the present invention, an undercoat layer containing a polymer having a repeating structural unit represented by the formula (1) shown above with the proviso that the polymer further having a repeating structural unit represented by the formula (2) shown above is excluded from the polymer having the repeating structural unit represented by the formula (1) shown above, is provided on a support. Hereinafter, the polymer is also referred to as "polymer according to the present invention".

The content of the polymer according to the present invention in an undercoat layer is desirably 50% by mass or more and 100% by mass or less, and more desirably 80% by mass or more and 100% by mass or less, with respect to the total mass of the undercoat layer.

Hereinafter, specific examples of $Z^1$ to $Z^4$ in the formulae (1) and (2) will be shown. Here, right and left directions in the formulae (1) and (2) shown above are identical with right and left directions of each group in Table 1-1.

TABLE 1

| | |
|---|---|
| 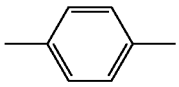 | Z11 |
| 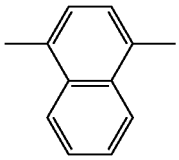 | Z12 |
| 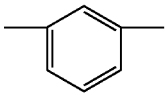 | Z13 |
| 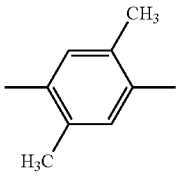  | Z14 |
| 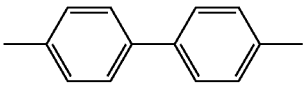 | Z15 |
| —$(CH_2)_2$— | Z16 |
| 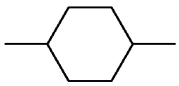 | Z17 |
| —$(CH_2)_6$— | Z18 |
| 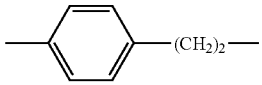  | Z19 |
| 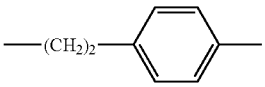  | Z20 |
| 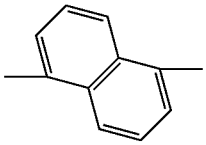 | Z21 |
| 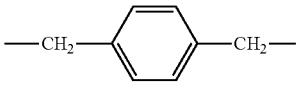  | Z22 |

TABLE 1-continued

| | |
|---|---|
| 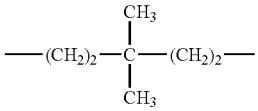  | Z23 |
| 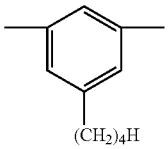  | Z24 |
| —$(CH_2)_{12}$— | Z25 |

Hereinafter, specific examples other than a single bond of $W^1$ and $W^2$ in the formulae (1) and (2) will be shown. Here, right and left directions of the formulae (1) and (2) and right and left directions of each group in Table 1-2 are identical.

TABLE 2

| | |
|---|---|
| 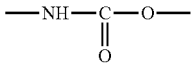  | W11 |
| 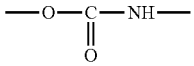  | W12 |
| 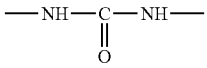  | W13 |

Hereinafter, specific examples of $B^1$ in the formula (1) will be shown. Here, right and left directions of the formula (1) shown above and right and left directions of each group in Table 1-3 are identical.

TABLE 3

| | |
|---|---|
| 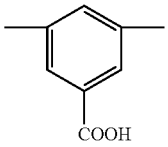  | B11 |
| 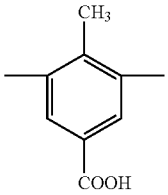  | B12 |
| 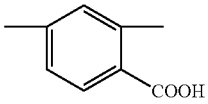  | B13 |
| 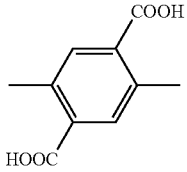  | B14 |

TABLE 3-continued

| | |
|---|---|
| 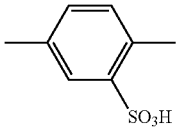 | B15 |
| 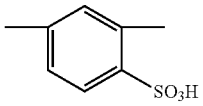 | B16 |
| 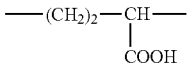 | B17 |
| 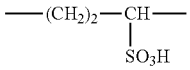 | B18 |
| 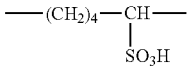 | B19 |
| 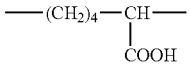 | B20 |
| 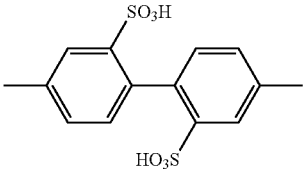 | B21 |

Hereinafter, specific examples of $A^1$ in the formula (1) (a divalent group represented by one of the formulae (A-1) to (A-8) shown above) will be shown. Here, right and left directions of the formulae (1) and (2) and right and left directions of each group in Tables 3-1 to 3-8 are identical.

In Tables 3-1 to 3-8, "bo" means a bonding site, "H" means a hydrogen atom, "Cl" means a chlorine atom, "N" means a nitrogen atom, "O" means an oxygen atom, "C" means a carbon atom, "dcyme" means a dicyanomethylene group, "me" means a methyl group, "et" means an ethyl group, "che" means a cyclohexyl group, "cy" means a cyano group, "ni" means a nitro group, "ph" means a phenyl group, "4flph" means 4-fluorophenyl group, "pflph" means a perfluorophenyl group, "4clph" means 4-chlorophenyl group, "4meph" means 4-methylphenyl group, "3me4flph" means a 3-methyl-4-fluorophenyl group, "4tflmeph" means a 4-(trifluoromethyl)phenyl group, "4cyph" means a 4-cyanophenyl group, "2niph" means a 2-nitrophenyl group, and "3niph" means a 3-nitrophenyl group.

TABLE 3-1

| (A-1) | $R^{101}$ | $R^{102}$ | $R^{103}$ | $R^{104}$ | $R^{105}$ | $R^{106}$ |
|---|---|---|---|---|---|---|
| A101 | H | H | H | H | bo | bo |
| A102 | H | ph | ph | H | bo | bo |
| A103 | H | 3niph | 3niph | H | bo | bo |
| A104 | H | pflph | pflph | H | bo | bo |
| A105 | H | 4cyph | H | H | bo | bo |
| A106 | H | 4meph | 4meph | H | bo | bo |
| A107 | H | 4tflmeph | 4tflmeph | H | bo | bo |
| A108 | H | me | me | H | bo | bo |
| A109 | H | cy | cy | H | bo | bo |
| A110 | H | bo | bo | H | ph | ph |
| A111 | H | bo | bo | H | 4meph | 4meph |
| A112 | H | bo | bo | H | pflph | pflph |
| A113 | H | bo | bo | H | me | me |
| A114 | H | bo | bo | H | che | che |

TABLE 3-2

| (A-2) | $R^{201}$ | $R^{202}$ | $R^{203}$ | $R^{204}$ | $R^{205}$ | $R^{206}$ | $R^{207}$ | $R^{208}$ | $R^{209}$ | $R^{210}$ |
|---|---|---|---|---|---|---|---|---|---|---|
| A201 | H | H | H | H | H | H | H | H | bo | bo |
| A202 | H | ph | H | H | H | ph | H | H | bo | bo |
| A202 | H | 3niph | H | H | H | 3niph | H | H | bo | bo |
| A203 | H | pflph | H | H | H | pflph | H | H | bo | bo |
| A204 | H | 4cyph | H | H | H | 4cyph | H | H | bo | bo |
| A205 | H | 4meph | H | H | H | 4meph | H | H | bo | bo |
| A206 | H | 4tflmeph | H | H | H | 4tflmeph | H | H | bo | bo |
| A207 | H | me | H | H | H | me | H | H | bo | bo |
| A207 | H | cy | H | H | H | cy | H | H | bo | bo |
| A208 | H | Cl | H | H | H | Cl | H | H | bo | bo |
| A209 | H | bo | H | H | H | bo | H | H | 3me4flph | che |

TABLE 3-3

| (A-3) | $R^{301}$ | $R^{302}$ | $R^{303}$ | $R^{304}$ | $R^{305}$ | $R^{306}$ | $R^{307}$ | $R^{308}$ | $R^{309}$ | $R^{310}$ | $R^{311}$ |
|---|---|---|---|---|---|---|---|---|---|---|---|
| A301 | H | H | bo | H | H | bo | H | H | O | C | C |
| A302 | H | bo | H | H | ni | H | bo | H | O | C | C |
| A303 | bo | H | et | H | H | et | H | bo | O | C | C |
| A304 | bo | H | cy | H | H | cy | H | bo | O | C | C |
| A305 | H | H | bo | H | H | bo | H | H | dcyme | C | C |
| A306 | H | bo | H | H | H | H | bo | H | dcyme | C | C |
| A307 | H | bo | H | H | H | H | bo | H | O | N | N |
| A308 | me | bo | H | H | H | H | bo | me | O | N | N |
| A309 | ph | bo | H | H | H | H | bo | ph | O | N | N |
| A310 | H | bo | H | H | H | H | bo | 2niph | O | N | N |
| A311 | 4flph | bo | H | H | H | H | bo | 4flph | O | N | N |

TABLE 3-4

| (A-4) | $R^{401}$ | $R^{402}$ | $R^{403}$ | $R^{404}$ | $R^{405}$ | $R^{406}$ | $R^{407}$ |
|---|---|---|---|---|---|---|---|
| A401 | H | H | bo | bo | H | H | O |
| A402 | H | H | bo | bo | H | ph | O |
| A403 | H | H | bo | bo | H | 4clph | O |
| A404 | H | bo | H | H | bo | 3niph | O |
| A405 | H | bo | H | H | bo | 4cyph | O |
| A406 | H | bo | H | H | bo | 4meph | O |
| A407 | H | bo | H | H | bo | 4tflmeph | O |

TABLE 3-4-continued

| (A-4) | $R^{401}$ | $R^{402}$ | $R^{403}$ | $R^{404}$ | $R^{405}$ | $R^{406}$ | $R^{407}$ |
|---|---|---|---|---|---|---|---|
| A408 | H | bo | H | H | bo | et | O |
| A409 | H | H | bo | bo | H | cy | O |
| A410 | H | bo | H | bo | H | ni | O |
| A411 | H | H | bo | bo | H | H | dcyme |
| A412 | H | bo | H | H | bo | H | dcyme |

TABLE 3-5

| (A-5) | $R^{501}$ | $R^{502}$ | $R^{503}$ | $R^{504}$ | $R^{505}$ | $R^{506}$ | $R^{507}$ | $R^{508}$ | $R^{509}$ | $R^{510}$ | $R^{511}$ | $R^{512}$ |
|---|---|---|---|---|---|---|---|---|---|---|---|---|
| A501 | H | H | bo | H | H | H | bo | H | O | O | C | C |
| A502 | bo | H | H | bo | H | H | H | H | O | O | C | C |
| A503 | bo | H | H | bo | ph | H | H | ph | O | O | C | C |
| A504 | bo | H | H | bo | 4flph | H | H | 4flph | O | O | C | C |
| A505 | bo | H | H | bo | 3niph | H | H | 3niph | O | O | C | C |
| A506 | bo | H | H | bo | 4cyph | H | H | 4cyph | O | O | C | C |
| A507 | bo | H | H | bo | 4meph | H | H | 4meph | O | O | C | C |
| A508 | bo | H | H | bo | 4tflmeph | H | H | 4tflmeph | O | O | C | C |
| A509 | bo | me | me | bo | H | H | H | H | O | O | C | C |
| A510 | bo | cy | cy | bo | H | H | H | H | O | O | C | C |
| A511 | bo | Cl | Cl | bo | H | H | H | H | O | O | C | C |
| A512 | bo | H | H | bo | F | F | F | F | O | O | C | C |
| A513 | bo | H | H | ni | bo | H | H | ni | O | O | C | C |
| A514 | — | H | bo | H | — | H | bo | H | O | O | N | N |
| A515 | H | H | bo | H | H | H | bo | H | dcyme | dcyme | C | C |
| A516 | bo | H | H | H | bo | H | H | H | dcyme | dcyme | C | C |
| A517 | H | H | bo | H | H | H | bo | H | dcyme | dcyme | N | N |

TABLE 3-6

| (A-6) | $R^{601}$ | $R^{602}$ | $R^{603}$ | $R^{604}$ | $R^{605}$ | $R^{606}$ | $R^{607}$ | $R^{608}$ | $R^{609}$ | $R^{610}$ | $R^{611}$ |
|---|---|---|---|---|---|---|---|---|---|---|---|
| A601 | H | bo | H | ph | ph | H | bo | H | O | C | C |
| A602 | H | bo | H | 4flph | 4flph | H | bo | H | O | C | C |
| A603 | H | bo | H | 3niph | 3niph | H | bo | H | O | C | C |
| A604 | H | bo | H | 4cyph | 4cyph | H | bo | H | O | C | C |
| A605 | H | bo | H | 4meph | 4meph | H | bo | H | O | C | C |
| A606 | H | bo | H | me | me | H | bo | H | O | C | C |
| A607 | H | bo | H | H | ni | H | bo | H | O | C | C |
| A608 | H | bo | H | H | $COO(CH_2)_8H$ | H | bo | H | O | C | C |
| A609 | H | bo | H | H | $COO(CH_2)_2H$ | H | bo | H | O | C | C |
| A610 | H | bo | H | H | H | H | bo | H | O | N | N |
| A611 | H | bo | H | H | H | H | bo | H | dcyme | C | C |
| A612 | H | bo | H | H | $COO(CH_2)_2H$ | H | bo | H | dcyme | C | C |
| A613 | H | bo | H | H | H | H | bo | H | dcyme | N | N |

TABLE 3-7

| (A-7) | $R^{701}$ | $R^{702}$ | $R^{703}$ | $R^{704}$ | $R^{705}$ | $R^{706}$ | $R^{707}$ | $R^{708}$ | $R^{709}$ | $R^{710}$ | $R^{711}$ | $R^{712}$ | $R^{713}$ | $R^{714}$ | $R^{715}$ |
|---|---|---|---|---|---|---|---|---|---|---|---|---|---|---|---|
| A701 | H | H | H | H | H | H | H | H | H | bo | H | bo | H | C | C |
| A702 | H | H | H | ph | ph | H | H | H | H | bo | H | bo | H | C | C |
| A703 | H | H | H | 4flph | 4flph | H | H | H | H | bo | H | bo | H | C | C |
| A704 | H | H | H | 3niph | 3niph | H | H | H | H | bo | H | bo | H | C | C |
| A705 | H | H | H | 4cyph | 4cyph | H | H | H | H | bo | H | bo | H | C | C |
| A706 | H | H | H | 4meph | 4meph | H | H | H | H | bo | H | bo | H | C | C |
| A707 | H | H | H | 4tflmeph | 4tflmeph | H | H | H | H | bo | H | bo | H | C | C |
| A708 | H | H | H | me | me | H | H | H | H | bo | H | bo | H | C | C |
| A709 | H | bo | H | H | H | H | bo | H | et | H | H | H | et | C | C |
| A710 | H | H | H | H | ni | H | H | H | H | bo | H | bo | H | C | C |
| A711 | H | ni | H | H | ni | H | ni | H | H | bo | H | bo | H | C | C |
| A712 | H | bo | H | H | H | H | bo | H | H | H | ni | H | H | C | C |
| A713 | H | bo | H | H | H | H | bo | H | H | H | cy | H | H | C | C |
| A714 | H | bo | H | H | H | H | bo | H | H | H | Cl | H | H | C | C |
| A715 | H | H | H | H | $COO(CH_2)_8H$ | H | H | H | H | bo | H | bo | H | C | C |
| A716 | H | bo | H | H | H | H | bo | H | H | H | H | H | H | N | N |
| A717 | H | H | H | H | H | H | H | H | H | bo | H | bo | H | N | N |

TABLE 3-8

| A-8 | $R^{801}$ | $R^{802}$ | $R^{803}$ | $R^{804}$ | $R^{805}$ | $R^{806}$ | $R^{807}$ | $R^{808}$ |
|---|---|---|---|---|---|---|---|---|
| A801 | bo | H | H | H | bo | H | H | H |
| A802 | bo | H | H | H | H | H | H | bo |
| A803 | bo | H | H | ph | ph | H | H | bo |
| A804 | bo | H | H | 4flph | 4flph | H | H | bo |
| A805 | bo | H | H | 3niph | 3niph | H | H | bo |
| A806 | bo | H | H | 4cyph | 4cyph | H | H | bo |
| A807 | bo | H | H | 4meph | 4meph | H | H | bo |
| A808 | bo | H | H | 4tflmeph | 4tflmeph | H | H | bo |
| A809 | bo | H | H | et | bo | H | H | et |
| A810 | bo | H | H | H | ni | H | H | bo |
| A811 | bo | H | H | cy | cy | H | H | bo |
| A812 | bo | H | H | Cl | Cl | H | H | bo |

Hereinafter, specific examples of the repeating structural unit represented by the formula (1) will be shown. Here, right and left directions of the formula (1) and right and left directions of each group in Tables 4-1 to 4-4 are identical. In Tables 4-1 to 4-4, "bo" means a bonding site.

TABLE 4-1

| | $A^1$ | $B^1$ | $W^1$ | $W^2$ | $Z^1$ | $Z^2$ |
|---|---|---|---|---|---|---|
| (101) | A101 | B11 | bo | bo | bo | bo |
| (102) | A101 | B13 | bo | bo | bo | bo |
| (103) | A101 | B15 | bo | bo | bo | bo |
| (104) | A101 | B17 | bo | bo | bo | bo |
| (105) | A102 | B16 | bo | bo | bo | bo |
| (106) | A104 | B18 | bo | bo | bo | bo |
| (107) | A109 | B11 | bo | bo | bo | bo |
| (108) | A110 | B11 | bo | bo | bo | bo |
| (109) | A101 | B11 | W11 | W12 | Z11 | Z11 |
| (110) | A109 | B11 | W11 | W12 | Z11 | Z11 |
| (111) | A110 | B11 | W11 | W12 | Z11 | Z11 |
| (112) | A101 | B11 | W11 | W12 | Z13 | Z13 |
| (113) | A104 | B14 | W11 | W12 | Z18 | Z18 |
| (114) | A114 | B12 | W11 | W12 | Z20 | Z19 |
| (115) | A101 | B11 | W13 | W13 | Z11 | Z11 |
| (116) | A103 | B12 | W13 | W13 | Z12 | Z12 |
| (117) | A105 | B17 | W13 | W13 | Z14 | Z14 |
| (118) | A106 | B11 | W13 | W13 | Z15 | Z15 |
| (119) | A107 | B12 | W13 | W13 | Z16 | Z16 |
| (120) | A108 | B16 | W13 | W13 | Z17 | Z17 |
| (121) | A111 | B18 | W13 | W13 | Z11 | Z11 |
| (122) | A112 | B13 | W13 | W13 | Z19 | Z20 |
| (123) | A113 | B11 | W13 | W13 | Z11 | Z11 |
| (124) | A114 | B11 | W13 | W13 | Z11 | Z11 |
| (201) | A201 | B11 | bo | bo | bo | bo |
| (202) | A201 | B11 | bo | bo | bo | bo |
| (203) | A201 | B13 | bo | bo | bo | bo |
| (204) | A201 | B15 | bo | bo | bo | bo |
| (205) | A207 | B11 | bo | bo | bo | bo |
| (206) | A207 | B12 | bo | bo | bo | bo |
| (207) | A207 | B14 | bo | bo | bo | bo |
| (208) | A208 | B11 | bo | bo | bo | bo |
| (209) | A208 | B17 | bo | bo | bo | bo |
| (210) | A201 | B11 | W11 | W12 | Z11 | Z11 |
| (211) | A207 | B11 | W11 | W12 | Z11 | Z11 |
| (212) | A208 | B11 | W11 | W12 | Z12 | Z12 |
| (213) | A202 | B11 | W11 | W12 | Z13 | Z13 |
| (214) | A209 | B13 | W11 | W12 | Z16 | Z16 |
| (215) | A201 | B11 | W13 | W13 | Z11 | Z11 |
| (216) | A207 | B11 | W13 | W13 | Z14 | Z14 |
| (217) | A208 | B11 | W13 | W13 | Z15 | Z15 |
| (218) | A203 | B14 | W13 | W13 | Z17 | Z17 |
| (219) | A205 | B16 | W13 | W13 | Z18 | Z18 |

TABLE 4-2

| | $A^1$ | $B^1$ | $W^1$ | $W^2$ | $Z^1$ | $Z^2$ |
|---|---|---|---|---|---|---|
| (301) | A301 | B11 | bo | bo | Z11 | Z11 |
| (302) | A303 | B12 | bo | bo | Z11 | Z11 |

TABLE 4-2-continued

| | $A^1$ | $B^1$ | $W^1$ | $W^2$ | $Z^1$ | $Z^2$ |
|---|---|---|---|---|---|---|
| (303) | A304 | B14 | bo | bo | Z13 | Z13 |
| (304) | A305 | B15 | bo | bo | Z11 | Z11 |
| (305) | A307 | B11 | bo | bo | Z11 | Z11 |
| (306) | A308 | B17 | bo | bo | Z11 | Z11 |
| (307) | A309 | B18 | bo | bo | Z11 | Z11 |
| (308) | A301 | B11 | W11 | W12 | Z11 | Z11 |
| (309) | A302 | B12 | W11 | W12 | Z12 | Z12 |
| (310) | A303 | B14 | W11 | W12 | Z13 | Z13 |
| (311) | A310 | B16 | W11 | W12 | Z16 | Z16 |
| (312) | A311 | B11 | W11 | W12 | Z11 | Z11 |
| (313) | A306 | B11 | W11 | W12 | Z14 | Z14 |
| (314) | A306 | B12 | W11 | W12 | Z15 | Z15 |
| (315) | A306 | B14 | W11 | W12 | Z18 | Z18 |
| (316) | A306 | B15 | W11 | W12 | Z19 | Z20 |
| (317) | A301 | B16 | W11 | W12 | Z13 | Z13 |
| (318) | A305 | B11 | W13 | W13 | Z11 | Z11 |
| (319) | A307 | B11 | W13 | W13 | Z17 | Z17 |
| (320) | A308 | B13 | W13 | W13 | Z19 | Z20 |
| (321) | A306 | B11 | W13 | W13 | Z15 | Z15 |
| (322) | A306 | B14 | W13 | W13 | Z17 | Z17 |
| (323) | A306 | B15 | W13 | W13 | Z18 | Z18 |
| (401) | A401 | B11 | bo | bo | Z11 | Z11 |
| (402) | A411 | B14 | bo | bo | Z12 | Z12 |
| (403) | A412 | B16 | bo | bo | Z13 | Z13 |
| (404) | A401 | B11 | W11 | W12 | Z11 | Z11 |
| (405) | A401 | B12 | W11 | W12 | Z18 | Z18 |
| (406) | A402 | B13 | W11 | W12 | Z16 | Z16 |
| (407) | A405 | B11 | W11 | W12 | Z17 | Z17 |
| (408) | A409 | B15 | W11 | W12 | Z19 | Z20 |
| (409) | A411 | B18 | W11 | W12 | Z14 | Z14 |
| (410) | A411 | B11 | W11 | W12 | Z11 | Z11 |
| (411) | A412 | B12 | W11 | W12 | Z11 | Z11 |
| (412) | A412 | B13 | W11 | W12 | Z14 | Z14 |
| (413) | A401 | B11 | W13 | W13 | Z11 | Z15 |
| (414) | A403 | B15 | W13 | W13 | Z13 | Z13 |
| (415) | A404 | B15 | W13 | W13 | Z15 | Z15 |
| (416) | A406 | B11 | W13 | W13 | Z11 | Z11 |
| (417) | A407 | B16 | W13 | W13 | Z18 | Z18 |
| (418) | A408 | B17 | W13 | W13 | Z19 | Z20 |
| (419) | A410 | B11 | W13 | W13 | Z16 | Z16 |
| (420) | A411 | B12 | W13 | W13 | Z11 | Z11 |
| (421) | A411 | B11 | W13 | W13 | Z13 | Z13 |
| (422) | A412 | B15 | W13 | W13 | Z18 | Z18 |

TABLE 4-3

| | $A^1$ | $B^1$ | $W^1$ | $W^2$ | $Z^1$ | $Z^2$ |
|---|---|---|---|---|---|---|
| (501) | A501 | B11 | bo | bo | Z11 | Z11 |
| (502) | A515 | B14 | bo | bo | Z11 | Z11 |
| (503) | A503 | B16 | bo | bo | Z13 | Z13 |
| (504) | A501 | B11 | W11 | W12 | Z12 | Z12 |
| (505) | A501 | B12 | W11 | W12 | Z18 | Z18 |
| (506) | A502 | B13 | W11 | W12 | Z16 | Z16 |
| (507) | A505 | B11 | W11 | W12 | Z17 | Z17 |
| (508) | A510 | B18 | W11 | W12 | Z19 | Z20 |
| (509) | A515 | B15 | W11 | W12 | Z11 | Z11 |
| (510) | A515 | B11 | W11 | W12 | Z11 | Z11 |
| (511) | A504 | B12 | W11 | W12 | Z11 | Z11 |
| (512) | A511 | B13 | W11 | W12 | Z14 | Z14 |
| (513) | A516 | B12 | W11 | W12 | Z18 | Z18 |
| (514) | A517 | B11 | W11 | W12 | Z11 | Z11 |
| (515) | A501 | B11 | W13 | W13 | Z11 | Z11 |
| (516) | A513 | B15 | W13 | W13 | Z13 | Z13 |
| (517) | A514 | B15 | W13 | W13 | Z15 | Z15 |
| (518) | A506 | B12 | W13 | W13 | Z11 | Z11 |
| (519) | A509 | B16 | W13 | W13 | Z18 | Z18 |
| (520) | A507 | B17 | W13 | W13 | Z19 | Z20 |
| (521) | A511 | B11 | W13 | W13 | Z16 | Z16 |
| (522) | A515 | B15 | W13 | W13 | Z11 | Z11 |
| (523) | A515 | B11 | W13 | W13 | Z13 | Z13 |
| (524) | A508 | B15 | W13 | W13 | Z18 | Z18 |
| (525) | A517 | B11 | W13 | W13 | Z13 | Z13 |
| (601) | A611 | B11 | bo | bo | Z11 | Z11 |
| (602) | A613 | B14 | bo | bo | Z11 | Z11 |

TABLE 4-3-continued

| | $A^1$ | $B^1$ | $W^1$ | $W^2$ | $Z^1$ | $Z^2$ |
|---|---|---|---|---|---|---|
| (603) | A607 | B16 | bo | bo | Z13 | Z13 |
| (604) | A611 | B11 | W11 | W12 | Z12 | Z12 |
| (605) | A611 | B12 | W11 | W12 | Z18 | Z18 |
| (606) | A603 | B13 | W11 | W12 | Z16 | Z16 |
| (607) | A608 | B11 | W11 | W12 | Z17 | Z17 |
| (608) | A609 | B18 | W11 | W12 | Z19 | Z20 |
| (609) | A613 | B15 | W11 | W12 | Z11 | Z11 |
| (610) | A613 | B11 | W11 | W12 | Z11 | Z11 |
| (611) | A612 | B12 | W11 | W12 | Z11 | Z11 |
| (612) | A608 | B13 | W11 | W12 | Z14 | Z14 |
| (613) | A611 | B11 | W13 | W13 | Z11 | Z11 |
| (614) | A601 | B15 | W13 | W13 | Z13 | Z13 |
| (615) | A610 | B15 | W13 | W13 | Z15 | Z15 |
| (616) | A602 | B12 | W13 | W13 | Z11 | Z11 |
| (617) | A608 | B16 | W13 | W13 | Z18 | Z18 |
| (618) | A604 | B17 | W13 | W13 | Z19 | Z20 |
| (619) | A606 | B11 | W13 | W13 | Z16 | Z16 |
| (620) | A613 | B15 | W13 | W13 | Z11 | Z11 |
| (621) | A613 | B11 | W13 | W13 | Z13 | Z13 |
| (622) | A605 | B15 | W13 | W13 | Z18 | Z18 |

TABLE 4-4

| | $A^1$ | $B^1$ | $W^1$ | $W^2$ | $Z^1$ | $Z^2$ |
|---|---|---|---|---|---|---|
| (701) | A717 | B11 | bo | bo | Z11 | Z11 |
| (702) | A711 | B14 | bo | bo | Z11 | Z11 |
| (703) | A708 | B16 | bo | bo | Z13 | Z13 |
| (704) | A717 | B11 | W11 | W12 | Z12 | Z12 |
| (705) | A717 | B12 | W11 | W12 | Z18 | Z18 |
| (706) | A707 | B13 | W11 | W12 | Z16 | Z16 |
| (707) | A701 | B11 | W11 | W12 | Z17 | Z17 |
| (708) | A706 | B18 | W11 | W12 | Z19 | Z20 |
| (709) | A711 | B15 | W11 | W12 | Z11 | Z11 |
| (710) | A711 | B11 | W11 | W12 | Z11 | Z11 |
| (711) | A709 | B12 | W11 | W12 | Z11 | Z11 |
| (712) | A705 | B13 | W11 | W12 | Z14 | Z14 |
| (713) | A715 | B11 | W11 | W12 | Z11 | Z11 |
| (714) | A716 | B11 | W11 | W12 | Z11 | Z11 |
| (715) | A717 | B11 | W13 | W13 | Z11 | Z11 |
| (716) | A710 | B15 | W13 | W13 | Z13 | Z13 |
| (717) | A713 | B15 | W13 | W13 | Z15 | Z15 |
| (718) | A702 | B12 | W13 | W13 | Z11 | Z11 |
| (719) | A712 | B16 | W13 | W13 | Z18 | Z18 |
| (720) | A704 | B17 | W13 | W13 | Z19 | Z20 |
| (721) | A714 | B11 | W13 | W13 | Z16 | Z16 |
| (722) | A711 | B15 | W13 | W13 | Z11 | Z11 |
| (723) | A711 | B11 | W13 | W13 | Z13 | Z13 |
| (724) | A703 | B15 | W13 | W13 | Z18 | Z18 |
| (801) | A802 | B11 | bo | bo | Z11 | Z11 |
| (802) | A803 | B14 | bo | bo | Z11 | Z11 |
| (803) | A807 | B16 | bo | bo | Z13 | Z13 |
| (804) | A802 | B11 | W11 | W12 | Z12 | Z12 |
| (805) | A802 | B12 | W11 | W12 | Z18 | Z18 |
| (806) | A811 | B13 | W11 | W12 | Z16 | Z16 |
| (807) | A805 | B11 | W11 | W12 | Z17 | Z17 |
| (808) | A810 | B18 | W11 | W12 | Z19 | Z20 |
| (809) | A803 | B15 | W11 | W12 | Z11 | Z11 |
| (810) | A803 | B11 | W11 | W12 | Z11 | Z11 |
| (811) | A812 | B12 | W11 | W12 | Z11 | Z11 |
| (812) | A804 | B13 | W11 | W12 | Z14 | Z14 |
| (813) | A802 | B11 | W13 | W13 | Z11 | Z11 |
| (814) | A801 | B15 | W13 | W13 | Z13 | Z13 |
| (815) | A801 | B15 | W13 | W13 | Z15 | Z15 |
| (816) | A809 | B12 | W13 | W13 | Z11 | Z11 |
| (817) | A804 | B16 | W13 | W13 | Z18 | Z18 |
| (818) | A806 | B17 | W13 | W13 | Z19 | Z20 |
| (819) | A810 | B11 | W13 | W13 | Z16 | Z16 |
| (820) | A803 | B15 | W13 | W13 | Z11 | Z11 |
| (821) | A803 | B11 | W13 | W13 | Z13 | Z13 |
| (822) | A808 | B15 | W13 | W13 | Z18 | Z18 |

In order to enhance film formability and electric characteristics, the undercoat layer may contain, in addition to the polymer according to the present invention, other resin, a crosslinking agent, organic particles, inorganic particles, a leveling agent and the like. Here, the content thereof in an undercoat layer is desirably less than 50% by mass, and more desirably less than 20% by mass, with respect to the total mass of the undercoat layer.

The polymer according to the present invention may further have a repeating structural unit other than the repeating structural unit represented by the formula (1) shown above with the proviso that the polymer further having the repeating structural unit represented by the formula (2) shown above is excluded from the polymer having the repeating structural unit represented by the formula (1) shown above. Here, the proportion of the repeating structural unit represented by the formula (1) shown above in the polymer according to the present invention is desirably 50 mol % or more and 100 mol % or less, and more desirably 70 mol % or more and 100 mol % or less, with respect to the total repeating structural unit in the polymer.

Hereinafter, specific examples of a repeating structural unit other than the repeating structural unit represented by the formula (1) shown above will be shown.

[Formula 3]

(91)

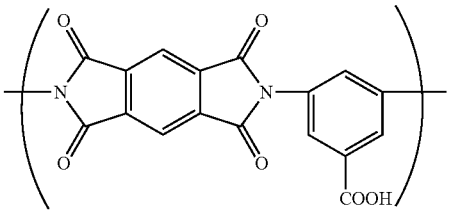

(92)

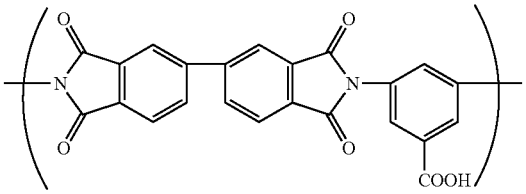

(93)

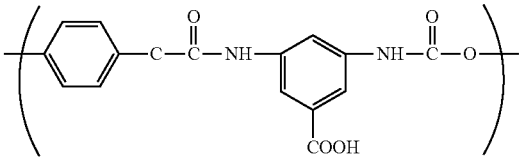

(94)

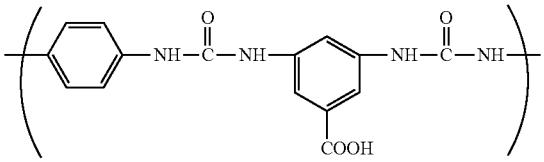

The weight-average molecular weight (Mw) of the polymer according to the present invention is desirably in the range of 5,000 to 15,000.

In order to form a structure of $W^1$ in the formula (1) shown above of the polymer according to the present invention, for example, the following reaction process may be used.

In the case where $W^1$ is a urethane bond, the urethane bond can be formed, for example, by causing a compound having a hydroxyl group to react with a compound having an isocyanate group ("FUNDAMENTAL FOUNDATION AND APPLICATION OF POLYURETHANE", published by CMC Publishing Co., Ltd., p. 3 (1986), in Japanese).

In the case where $W^1$ is a urea bond, the urea bond can be formed, for example, by causing a compound having an amino group to react with a compound having an isocyanate group ("SYNTHESIS AND REACTION OF POLYMER (2)", published by Kyoritsu Shuppan Co., Ltd., p. 326 (1991), in Japanese).

In the case where $W^1$ is a single bond, the single bond can be formed, for example, by a coupling reaction using a halogenated material and a boronic acid derivative as raw materials and using a palladium catalyst (for example, tetrakistriphenylphosphine palladium) under a basic condition (Angew. Chem. Int. Ed. 2005, 44, 4442). A single bond is also known to be produced by other types of reactions.

The polymer according to the present invention can be synthesized by the polymerization between compounds having a polymerizable functional group such as an amino group, a hydroxyl group, an isocyanate group, a halogen group, a boronic acid group and a carboxylic anhydride group. In the case where a polymer is synthesized in such a way, it is needed that a compound having a polymerizable functional group and a skeleton corresponding to $A^1$, and a compound having a polymerizable functional group and a skeleton corresponding to $B^1$ are prepared, and a polymerization reaction to form a single bond, a urethane bond or a urea bond of $W^1$ is carried out using the prepared compounds.

A derivative having a structure of (A-1) as a main skeleton (which means a compound having a polymerizable functional group and a skeleton corresponding to the formula (A-1) shown above; hereinafter the same) can be synthesized, for example, by using synthesis methods described in U.S. Pat. No. 4,442,193, U.S. Pat. No. 4,992,349, U.S. Pat. No. 5,468,583, and Chemistry of materials, Vol. 19, No. 11, 2703-2705 (2007). The compound can be synthesized, for example, by the reaction of naphthalenetetracarboxylic dianhydride with a monoamine derivative, which are commercially available as reagents from Tokyo Chemical Industry Co., Ltd., Sigma-Aldrich Japan Corp. and Johnson Matthey Japan Inc.

In order to make the compound have a polymerizable functional group, there are, for example, a method in which a skeleton corresponding to the formula (A-1) shown above is synthesized, and thereafter, a polymerizable functional group is incorporated into the skeleton, and additionally a method using a naphthalenetetracarboxylic dianhydride derivative or monoamine derivative having a polymerizable functional group, a functional group as a precursor of a polymerizable functional group, or a functional group capable of bonding to another compound having a polymerizable functional group.

There is also a method of synthesizing the polymer according to the present invention directly by causing a naphthalenetetracarboxylic dianhydride derivative to react with a diamine derivative. In this case, $Z^1$, $Z^2$ and $W^1$ in the formula (1) shown above are single bonds.

A derivative having a structure of (A-2) as a main skeleton can be synthesized, for example, by using a synthesis method described in Journal of the American chemical society, Vol. 129, No. 49, 15259-78 (2007). The compound can be synthesized, for example, by the reaction of perylenetetracarboxylic dianhydride with a monoamine derivative, which are commercially available as reagents from Tokyo Chemical Industry Co., Ltd., Sigma-Aldrich Japan Corp. and Johnson Matthey Japan Inc.

In order to make the compound have a polymerizable functional group, there are, for example, a method in which a skeleton corresponding to the formula (A-2) shown above is synthesized, and thereafter, a polymerizable functional group is incorporated into the skeleton, and additionally a method using a perylenetetracarboxylic dianhydride derivative or monoamine derivative having a polymerizable functional group, a functional group as a precursor of the polymerizable functional group, or a functional group capable of bonding to another compound having a polymerizable functional group.

There is also a method of synthesizing the polymer according to the present invention directly by causing a perylenetetracarboxylic dianhydride derivative to react with a diamine derivative. In this case, $Z^1$ and $W^1$ in the formula (1) shown above are single bonds.

A derivative having a structure of (A-3) as a main skeleton is, for example, commercially available as a reagent from Tokyo Chemical Industry Co., Ltd., Sigma-Aldrich Japan Corp. or Johnson Matthey Japan Inc. The compound can also be synthesized by synthesis methods described in Bull. Chem. Soc. Jpn., Vol. 65, 1006-1011 (1992), Chem. Educator No. 6, 227-234 (2001), Journal of Synthetic Organic Chemistry, Japan, vol. 15, 29-32 (1957) and Journal of Synthetic Organic Chemistry, Japan, vol. 15, 32-34 (1957), based on a phenanthrene derivative or phenanthroline derivative, which are commercially available. A dicyanomethylene group can also be incorporated by the reaction with malononitrile.

In order to make the compound have a polymerizable functional group, there are, for example, a method in which a skeleton corresponding to the formula (A-3) shown above is synthesized, and thereafter, a polymerizable functional group is incorporated, and additionally a method of incorporating a polymerizable functional group or a structure having a functional group as a precursor of a polymerizable functional group (for example, a method using a cross-coupling reaction using a palladium catalyst, based on a halogenated material of a phenanthrene derivative or a phenanthroline derivative).

A derivative having a structure of (A-4) as a main skeleton is, for example, commercially available as a reagent from Tokyo Chemical Industry Co., Ltd., Sigma-Aldrich Japan Corp. or Johnson Matthey Japan Inc. The compound can also be synthesized by synthesis methods described in Tetrahedron Letters, 43(16), 2991-2994 (2002) and Tetrahedron Letters, 44(10), 2087-2091 (2003), based on an acenaphthenequinone derivative, which is commercially available. A dicyanomethylene group can also be incorporated by the reaction with malononitrile.

In order to make the compound have a polymerizable functional group, there are, for example, a method in which a skeleton corresponding to the formula (A-4) shown above is synthesized, and thereafter, a polymerizable functional group is incorporated, and additionally a method of incorporating a polymerizable functional group or a structure having a functional group as a precursor of a polymerizable functional group (for example, a method using a cross-coupling reaction using a palladium catalyst, based on a halogenated material of an acenaphthenequinone derivative).

A derivative having a structure of (A-5) as a main skeleton is, for example, commercially available as a reagent from Tokyo Chemical Industry Co., Ltd., Sigma-Aldrich Japan Corp. or Johnson Matthey Japan Inc. The compound can also be synthesized by a synthesis method described in Synthesis, Vol. 5, p. 388-389 (1988), by using compounds commercially available. A dicyanomethylene group can also be incorporated by the reaction with malononitrile.

In order to make the compound have a polymerizable functional group, there are, for example, a method in which a skeleton corresponding to the formula (A-5) shown above is synthesized, and thereafter, a polymerizable functional group is incorporated, and additionally a method of incorporating a polymerizable functional group or a structure having a functional group as a precursor of a polymerizable functional group (for example, a method using a cross-coupling reaction using a palladium catalyst, based on a halogenated material of an anthraquinone derivative).

A derivative having a structure of (A-6) as a main skeleton can be synthesized, for example, through a synthesis method described in U.S. Pat. No. 4,562,132 by using a fluorenone derivative and malononitrile, which are commercially available as reagents from Tokyo Chemical Industry Co., Ltd., Sigma-Aldrich Japan Corp. or Johnson Matthey Japan Inc.

In order to make the compound have a polymerizable functional group, there are, for example, a method in which a skeleton corresponding to the formula (A-6) shown above is synthesized, and thereafter, a polymerizable functional group is incorporated, and additionally a method of incorporating a polymerizable functional group or a structure having a functional group as a precursor of a polymerizable functional group.

A derivative having a structure of (A-7) as a main skeleton can also be synthesized, for example, by using synthesis methods described in Japanese Patent Application Laid-Open No. H5-279582 and Japanese Patent Application Laid-Open No. H7-70038 by using a fluorenone derivative and an aniline derivative, which are commercially available from Tokyo Chemical Industry Co., Ltd., Sigma-Aldrich Japan Corp. or Johnson Matthey Japan Inc.

In order to make the compound have a polymerizable functional group, there are, for example, a method in which a skeleton corresponding to the formula (A-7) shown above is synthesized, and thereafter, a polymerizable functional group is incorporated, and additionally a method of incorporating a polymerizable functional group or a structure having a functional group as a precursor of a polymerizable functional group, and a method using an aniline derivative having a polymerizable functional group, a functional group as a precursor of a polymerizable functional group, or a functional group capable of bonding to another compound having a polymerizable functional group.

A derivative having a structure of (A-8) as a main skeleton can be synthesized by using synthesis methods described in Japanese Patent Application Laid-Open No. H1-206349 and PPCI/Japan Hard Copy '98 Proceedings, p. 207 (1998). The compound can be synthesized, for example, by using as a raw material a phenol derivative commercially available as a reagent from Tokyo Chemical Industry Co., Ltd. or Sigma-Aldrich Japan Corp.

In order to make the compound have a polymerizable functional group, there are, for example, a method in which a skeleton corresponding to the formula (A-8) shown above is synthesized, and thereafter, a polymerizable functional group is incorporated, and additionally a method of incorporating a polymerizable functional group or a structure having a functional group as a precursor of a polymerizable functional group.

A derivative having a structure of $B^1$ having a polymerizable functional group as a main skeleton is, for example, commercially available as a reagent from Tokyo Chemical Industry Co., Ltd., Sigma-Aldrich Japan Corp. or Johnson Matthey Japan Inc. The compound can also be synthesized by using reagents commercially available.

The polymer according to the present invention and the like were confirmed by the following methods.

Confirmation of Raw Materials for Synthesizing the Polymer

The confirmation was carried out by mass spectroscopy. The molecular weight was measured using a mass spectrometer (MALDI-TOF MS, ultraflex made by Bruker Daltonics GmbH) under the conditions of the acceleration voltage: 20 kV, the mode: Reflector, and the molecular weight standard material: fullerene C60. The molecular weight was confirmed using the peak top value.

Confirmation of the Polymer

The confirmation of the structure was carried out using NMR. The structure was confirmed using $^1$H-NMR and $^{13}$C-NMR spectrometries (FT-NMR, JNM-EX400 made by JEOL Ltd.) in 1,1,2,2-tetrachloroethane (d2) or dimethyl sulfoxide (d6) at 120° C. The quantitative determination of a carboxyl group was carried out using FT-IR; a calibration curve based on the absorption of the carboxyl group was fabricated using samples obtained by varying the amount of benzoic acid added with respect to KBr powder by using KBr-tab method, to quantitatively determine the amount of the carboxyl group in the polymer.

[Photosensitive Layer]

A photosensitive layer containing a charge generation material and a hole transport material is provided on an undercoat layer.

The photosensitive layer containing a charge generation material and a hole transport material includes one in which a charge generation layer containing a charge generation material and a hole transport layer containing a hole transport material are laminated in this order from a support side (hereinafter, also referred to as "multilayer-type photosensitive layer"), and one in which a charge generation material and a hole transport material are contained in a same layer (hereinafter, also referred to as "monolayer-type photosensitive layer"). The charge generation layer and the hole transport layer may be provided in plural numbers, respectively.

Examples of the charge generation material include azo pigments such as monoazo, bisazo and trisazo ones, perylene pigments such as perylene acid anhydride and perylene acid imide, quinone pigments such as anthraquinone derivatives, anthoanthrone derivatives, dibenzopyrene quinone derivatives, pyranthrone derivatives, violanthrone derivatives and isoviolanthrone derivatives, indigoid pigments such as indigo derivatives and thioindigo derivatives, phthalocyanine pigments such as metal phthalocyanines and non-metal phthalocyanine, and perinone pigments such as bisbenzimidazole derivatives. Among these, desirable are azo pigments and phthalocyanine pigments. Among the phthalocyanine pigments, desirable are oxytitanium phthalocyanine, chlorogallium phthalocyanine and hydroxygallium phthalocyanine.

Desirable oxytitanium phthalocyanines are an oxytitanium phthalocyanine crystal of a crystal form exhibiting strong peaks at 9.0°, 14.2°, 23.9° and 27.1° of Bragg angles (2θ±0.2°) in CuKα characteristic X-ray diffraction, and an oxytitanium phthalocyanine crystal of a crystal form exhibiting strong peaks at 9.5°, 9.7°, 11.7°, 15.0°, 23.5°, 24.1° and 27.3° of the Bragg angles (2θ±0.2°).

Desirable chlorogallium phthalocyanines are a chlorogallium phthalocyanine crystal of a crystal form exhibiting strong peaks at 7.4°, 16.6°, 25.5° and 28.2° of Bragg angles (2θ±0.2°) in CuKα characteristic X-ray diffraction, a chlorogallium phthalocyanine crystal of a crystal form exhibiting strong peaks at 6.8°, 17.3°, 23.6° and 26.9° of the Bragg angles (2θ±0.2°), and a chlorogallium phthalocyanine crystal of a crystal form exhibiting strong peaks at 8.7°, 9.2°, 17.6°, 24.0°, 27.4° and 28.8° of the Bragg angles (2θ±0.2°).

Desirable hydroxylgallium phthalocyanines are a hydroxylgallium phthalocyanine crystal of a crystal form exhibiting strong peaks at 7.3°, 24.9° and 28.1° of Bragg angles (2θ±0.2°) in CuKα characteristic X-ray diffraction, and a hydroxylgallium phthalocyanine crystal of a crystal form exhibiting strong peaks at 7.5°, 9.9°, 12.5°, 16.3°, 18.6°, 25.1° and 28.3° of the Bragg angles (2θ±0.2°).

In the present invention, the Brag angle in CuKα characteristic X-ray diffraction of a crystal form of a phthalocyanine crystal was measured under the following conditions.

Measuring apparatus: a full automatic X-ray diffractometer, made by Mac Science Co., Ltd. (trade name: MXP18)

X-ray bulb: Cu
Bulb voltage: 50 kV
Bulb current: 300 mA
Scan method: 2θ/θ scan
Scan speed: 2°/min
Sampling interval: 0.020°
Start angle (2θ): 5°
Stop angle (2θ): 40°
Divergence slit: 0.5°
Scattering slit: 0.5°
Receiving slit: 0.3°
Using a curved monochromator In the case where a photosensitive layer is a multilayer-type photosensitive layer, examples of a binder resin used for a charge generation layer include polymers and copolymers of vinyl compounds such as styrene, vinyl acetate, vinyl chloride, acrylic ester, methacrylic ester, vinylidene fluoride and trifluoroethylene, and polyvinyl alcohol, polyvinyl acetal, polycarbonate, polyester, polysulfone, polyphenylene oxide, polyurethane, cellulosic resins, phenol resins, melamine resins, silicon resins and epoxy resins. Among these, desirable are polyester, polycarbonate and polyvinyl acetal, and among these, more desirable is polyvinyl acetal.

In a charge generation layer, the ratio of a charge generation material to a binder resin (charge generation material/binder resin) is desirably in the range of 10/1 to 1/10, and more desirably 5/1 to 1/5.

The film thickness of a charge generation layer is desirably 0.05 μm or more and 5 μm or less.

Examples of a hole transport material include polycyclic aromatic compounds, heterocyclic compounds, hydrazone compounds, styryl compounds, benzidine compounds, triarylamine compounds and triphenylamine, and also include polymers having groups derived from these compounds on their main chains or side chains.

In the case where a photosensitive layer is a multilayer-type photosensitive layer, examples of a binder resin used for a hole transport layer include polyester, polycarbonate, polymethacrylic ester, polyarylate, polysulfone and polystyrene. Among these, desirable are polycarbonate and polyarylate. The weight-average molecular weight (Mw) of these is desirably in the range of 10,000 to 300,000.

In a hole transport layer, the ratio of a hole transport material to a binder resin (hole transport material/binder resin) is desirably in the range of 10/5 to 5/10, and more desirably 10/8 to 6/10.

The film thickness of a hole transport layer is desirably 5 μm or more and 40 μm or less.

Another layer, including a conductive layer in which a conductive particle such as a metal oxide or carbon black is dispersed in a resin, and a second undercoat layer containing no polymer according to the present invention, may be provided between the support and the undercoat layer, and the undercoat layer and the photosensitive layer.

A protective layer (surface protective layer) containing a conductive particle or a hole transport material and a binder resin may be provided on the photosensitive layer (hole transport layer). Additives such as lubricants may be further incorporated into the protective layer. A resin (binder resin) itself of the protective layer may be imparted with conductivity and positive-hole transportability, and in this case, the protective layer may contain no conductive particle and hole transport material excluding the resin. The binder resin of the protective layer may be a thermoplastic resin, or may be a curable resin to be cured by heat, light, radiation (electron beams and the like) or the like.

A desirable method for forming each layer, including an undercoat layer, a charge generation layer and a hole transport layer, constituting an electrophotographic photosensitive member is a method in which a coating liquid obtained by dissolving and/or dispersing materials constituting each layer in a solvent is applied, and the obtained coating film is dried and/or cured to form the each layer. Examples of methods of applying a coating liquid include an immersion coating method (dip coating method), a spray coating method, a curtain coating method and a spin coating method. Among these, the immersion coating method is desirable from the viewpoint of efficiency and productivity.

[Process Cartridge and Electrophotographic Apparatus]

FIG. 1 illustrates a schematic diagram of an electrophotographic apparatus having a process cartridge equipped with the electrophotographic photosensitive member according to the present invention.

In FIG. 1, a drum-like electrophotographic photosensitive member 1 according to the present invention is rotationally driven round a rotary shaft 2 in the arrow direction at a predetermined circumferential speed. A surface (circumferential surface) of the electrophotographic photosensitive member 1 is charged at a positive or negative predetermined voltage by a charging device 3 (for example, a contact-type primary electrifier, a non-contact type primary electrifier or the like) in the course of rotation. Then, exposure light (image exposure light) 4 (for example, laser light) from an exposure device (image exposure device) (not shown in figure) of slit exposure light, laser beam scanning exposure light or the like is received. An electrostatic latent image is thus formed successively on the surface of the electrophotographic photosensitive member 1.

The formed electrostatic latent image is then developed with a toner of a developing device 5 (for example, a contact-type developer, a non-contact-type developer or the like). The obtained toner image is transferred successively onto a transfer material 7 (for example, paper) by a transfer device 6. The transfer material 7 is taken out from a transfer material feed part not shown in figure synchronously with the rotation of the electrophotographic photosensitive member 1, and fed to between the electrophotographic photosensitive member 1 and the transfer device 6 (for example, a transfer electrifier).

The transfer material 7 on which the toner image has been transferred is separated from the surface of the electrophotographic photosensitive member 1, introduced to a fixing device 8 to be subjected to image fixation, and printed out of the electrophotographic apparatus as a reproduction (copy).

The surface of the electrophotographic photosensitive member 1 after the toner transfer is subjected to removal of the transfer residual toner by a cleaning device 9 to be cleaned, further subjected to a charge elimination treatment with pre-exposure light from a pre-exposure device (not shown in figure), and then used repeatedly for image formations.

For the charging device 3, a scorotron electrifier or corotron electrifier utilizing corona discharge may be used, or a contact-type electrifier equipped with a charging member having a roller shape, a blade shape, a brush shape or the like may be used.

In the present invention, the electrophotographic photosensitive member 1, and at least one device selected from constituting elements including the charging device 3, the developing device 5, the transfer device 6 and the cleaning device 9 may be integrally combined and constituted as a process cartridge; and the process cartridge may be adapted detachably mountable to an electrophotographic apparatus such as a copying machine or a laser beam printer. For example, at least one device of the charging device 3, the developing device 5 and the cleaning device 9, together with the electrophotographic photosensitive member 1, is integrally supported to make a cartridge, and a process cartridge 10 being detachably mountable to the main body of the electrophotographic apparatus can be made using a guiding device such as rails 11 and 12 of the main body of the electrophotographic apparatus.

In the case where the electrophotographic apparatus is a copying machine or a printer, the exposure light 4 is light reflected from or transmitted through a manuscript, or light irradiated by scanning of a laser beam, driving of an LED array or driving of a liquid crystal shutter array, according to signals to which a manuscript read by a sensor is converted.

EXAMPLES

Hereinafter, the present invention will be described in more detail by way of Examples. Here, "parts" in Examples means "parts by mass".

First, Synthesis Examples for the polymers according to the present invention will be described.

The weight-average molecular weight (Mw) of a polymer after the synthesis was measured by GPC (which was carried out using gel permeation chromatography, "HLC-8120" made by Tosoh Corp., and calculated in terms of polystyrene.).

Synthesis Example 1

Synthesis of a Polymer Having a Repeating Structural Unit (101)

5.4 parts of naphthalenetetracarboxylic dianhydride and 3.0 parts of 3,5-diaminobenzoic acid were added to 200 parts of dimethylacetamide under a nitrogen atmosphere, and stirred at room temperature for 1 hour. After the raw materials were dissolved, the solution was refluxed for 8 hours; and a deposit was filtered out, and washed with acetone to obtain 6.2 parts of a target polymer. The obtained polymer was particulate.

Synthesis Example 2

Synthesis of a Polymer Having a Repeating Structural Unit (201)

7.8 parts of perylenetetracarboxylic dianhydride and 3.0 parts of 3,5-diaminobenzoic acid were added to 200 parts of dimethylacetamide under a nitrogen atmosphere, and stirred at room temperature for 1 hour. Thereafter, the mixture was refluxed for 8 hours; a deposit was filtered out, and washed with acetone to obtain 7.5 parts of a target polymer. The obtained polymer was particulate.

Synthesis Example 3

Synthesis of a Polymer Having a Repeating Structural Unit (109)

5.4 parts of naphthalenetetracarboxylic dianhydride and 5.5 parts of 4-aminobenzoic acid were added to 200 parts of dimethylacetamide under a nitrogen atmosphere, and stirred at room temperature for 1 hour. After the raw materials were dissolved, the solution was refluxed for 8 hours; and a deposit was filtered out, and recrystallized with ethyl acetate to obtain 7.6 parts of a compound represented by the following structural formula (11):

[Formula 4]

(11)

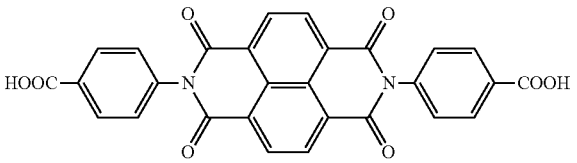

Then, 5.1 parts of the compound represented by the structural formula (11) shown above was reacted, for isocyanation, with diphenylphosphoryl azide in DMF in the presence of triethylamine, by using a method described in Tetrahedron, vol. 30, 1974, 2151. 1.5 parts of 3,5-dihydroxybenzoic acid was added thereto, and refluxed for 8 hours; and a deposit was filtered out, and washed with acetone to obtain 4.9 parts of a target polymer. The obtained polymer was particulate.

Synthesis Example 4

Synthesis of a Polymer Having a Repeating Structural Unit (318)

6.7 parts of 4-carboxyphenylboronic acid was added to a mixed solvent of 100 parts of toluene and 50 parts of ethanol; 7.4 parts of 3,6-dibromo-9,10-phenanthrenedione synthesized by a synthesis method described in Chem. Educator No. 6, 227-234 (2001) was further added under a nitrogen atmosphere; and 100 parts of a 20% sodium carbonate aqueous solution was dropwise charged. Thereafter, 0.55 part of tetrakis(triphenylphosphine)palladium(0) was added, and then the mixture was refluxed for 2 hours. After the reaction, an organic phase was extracted with chloroform, washed with water, and thereafter dried with anhydrous sodium sulfate. After the solvent was removed under reduced pressure, the residual material was purified by silica gel chromatography to obtain 5.2 parts of a compound represented by the following structural formula (12):

[Formula 5]

(12)

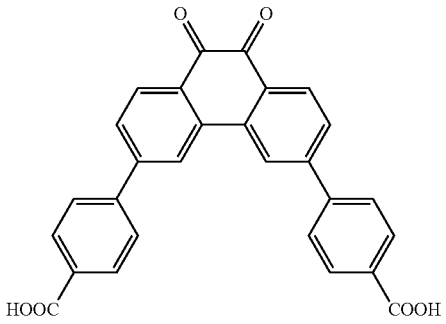

Then, 0.7 part of dicyanomethylenemalononitrile was added to 4.5 parts of the compound represented by the structural formula (12) shown above, and refluxed in tetrahydrofuran for 12 hours. After the solution was allowed to cool, a deposited purple crystal was filtered out, and recrystallized with ethyl acetate to obtain 3.7 parts of a compound represented by the following structural formula (13):

[Formula 6]

(13)

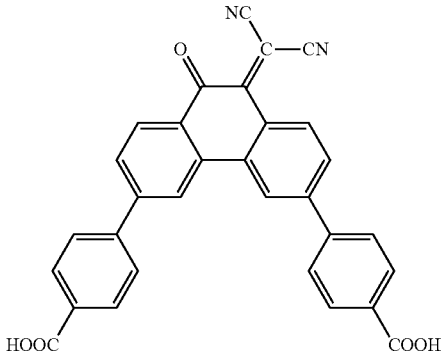

Then, 2.5 parts of the compound represented by the structural formula (13) shown above was reacted, for isocyanation, with diphenylphosphoryl azide in DMF in the presence of triethylamine, by using a method described in Tetrahedron, vol. 30, 1974, 2151. 0.8 part of 3,5-diaminobenzoic acid was added thereto, and refluxed for 8 hours; and a deposit was filtered out, and washed with acetone to obtain 2.9 parts of a target polymer. The obtained polymer was particulate.

Synthesis Example 5

Synthesis of a Polymer Having a Repeating Structural Unit (515)

6.8 parts of 2,6-dibromoanthraquinone and 6.7 parts of 4-carboxyphenylboronic acid were added to a mixed solvent of 100 parts of toluene and 50 parts of ethanol under a nitrogen atmosphere; and 100 parts of a 20% sodium carbonate aqueous solution was dropwise added. Thereafter, 0.55 part of tetrakis-(triphenylphosphine)palladium(0) was added, and then the mixture was refluxed for 2 hours. After the completion of the reaction, an organic phase was extracted with chloroform, washed with water, and thereafter dried with anhydrous sodium sulfate. After the solvent was removed under reduced pressure, the residual material was purified by silica gel chromatography to obtain 8.2 parts of a compound represented by the following structural formula (14):

[Formula 7]

(14)

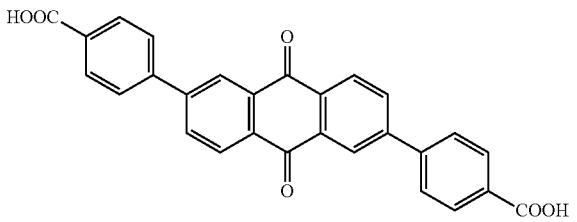

Then, 2.5 parts of the compound represented by the structural formula (14) shown above was reacted, for isocyanation, with diphenylphosphoryl azide in DMF in the presence of triethylamine, by using a method described in Tetrahedron, vol. 30, 1974, 2151. 0.8 part of 3,5-diaminobenzoic acid was added thereto, and refluxed for 8 hours; and a deposit was filtered out, and washed with acetone to obtain 2.9 parts of a target polymer. The obtained polymer was particulate.

Synthesis Example 6

Synthesis of a Polymer Having a Repeating Structural Unit (103)

5.4 parts of naphthalenetetracarboxylic dianhydride and 3.7 parts of 1,4-phenylenediamine-2-sulfonic acid were added to 200 parts of dimethylacetamide under a nitrogen atmosphere, and stirred at room temperature for 1 hour. After the raw materials were dissolved, the solution was refluxed for 8 hours; and a deposit was filtered out, and washed with acetone to obtain 5.8 parts of a target polymer. The obtained polymer was particulate.

Synthesis Example 7

Synthesis of a Polymer Having a Repeating Structural Unit (901) and a Repeating Structural Unit Represented by the Structural Formula (91) Shown Above in 7:3 (Molar Ratio)

3.8 parts of naphthalenetetracarboxylic dianhydride, 0.7 part of pyromellitic anhydride and 3.0 parts of 3,5-diaminobenzoic acid were added to 200 parts of dimethylacetamide under a nitrogen atmosphere, and stirred at room temperature for 1 hour. After the raw materials were dissolved, the solution was refluxed for 8 hours; and a deposit was filtered out, and washed with acetone to obtain 5.6 parts of a target polymer. The obtained polymer was particulate.

Then, fabrication and evaluation of electrophotographic photosensitive members will be described.

Example 1

An aluminum cylinder (JIS-A3003, aluminum alloy) of 260.5 mm in length and 30 mm in diameter was used as a support (conductive support).

Then, 50 parts of a titanium oxide particles covered with an oxygen-deficient tin oxide (powder resistivity: 120 Ω·cm, coverage of tin oxide: 40%) as a conductive particle, 40 parts of a phenol resin (Plyophen J-325, made by Dainippon Ink and Chemicals, Inc., resin solid content: 60%) as a binder resin, and 40 parts of methoxypropanol as a solvent (disperse medium) were charged in a sand mill using glass beads of 1 mm in diameter, and subjected to a dispersion treatment for 3 hours to prepare a coating liquid (dispersion liquid) for a conductive layer.

The average particle diameter of the titanium oxide particle covered with an oxygen-deficient tin oxide in the coating liquid for a conductive layer was measured using a particle size distribution analyzer (trade name: CAPA700) made by HORIBA Ltd., by a centrifugal sedimentation method using tetrahydrofuran as a disperse medium and at a rotation frequency of 5,000 rpm. As a result, the average particle diameter was 0.33 μm.

The support was immersion coated with the coating liquid for a conductive layer; and the obtained coating film was dried and thermally cured for 30 min at 145° C. to form a conductive layer of 16 μm in film thickness.

Then, 300 parts of distilled water, 500 parts of methanol and 8 parts of triethylamine as a disperse medium were added to 40 parts of particles of the polymer having a repeating structural unit (101); and the mixture was charged in a sand mill using glass beads of 1 mm in diameter, and subjected to a dispersion treatment for 2 hours to prepare a coating liquid (dispersion liquid) for an undercoat layer.

The average particle diameters of the particles of the polymer before and after the preparation of the coating liquid for an undercoat layer were measured using a particle size distribution analyzer (trade name: CAPA700) made by HORIBA Ltd., by a centrifugal sedimentation method using methanol as a disperse medium and at a rotation frequency of 7,000 rpm. The results are shown in Tables 5-1 to 5-3.

The conductive layer was immersion coated with the coating liquid for an undercoat layer; and the obtained coating film was heated for 10 min at 120° C. to evaporate the disperse medium and to melt and aggregate (dry) the particles of the polymer, whereby an undercoat layer of 1.0 μm in film thickness was formed.

Then, 10 parts of a hydroxylgallium phthalocyanine crystal (charge generation material) of a crystal form exhibiting strong peaks at 7.5°, 9.9°, 12.5°, 16.3°, 18.6°, 25.1° and 28.3° of Bragg angles (2θ±0.2°) in CuKα characteristic X-ray diffraction, 5 parts of a polyvinylbutyral (trade name: S-LEC BX-1, made by Sekisui Chemical Co., Ltd.), and 260 parts of cyclohexanone were charged in a sand mill using glass beads of 1 mm in diameter, and subjected to a dispersion treatment for 1.5 hours. Then, 240 parts of ethyl acetate was added thereto, whereby a coating liquid for a charge generation layer was prepared.

The undercoat layer was immersion coated with the coating liquid for a charge generation layer; and the obtained coating film was dried for 10 min at 95° C. to form a charge generation layer of 0.18 μm in film thickness.

Then, 7 parts of an amine compound (hole transport material) represented by the following structural formula (15):

[Formula 8]

(15)

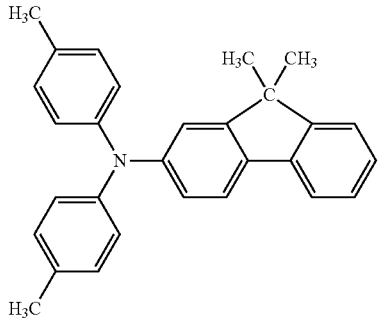

and 10 parts of a polyarylate having a repeating structural unit represented by the following formula (16):

[Formula 9]

(16)

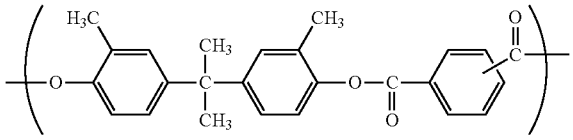

and having a weight-average molecular weight (Mw) of 100,000 (which was measured by gel permeation chromatography "HLC-8120", made by Tosoh Corp., and calculated in terms of polystyrene) were dissolved in a mixed solvent of 30 parts of dimethoxymethane and 70 parts of chlorobenzene to prepare a coating liquid for a hole transport layer.

The charge generation layer was immersion coated with the coating liquid for a hole transport layer; and the obtained coating film was dried for 40 min at 120° C. to form a hole transport layer of 18 μm in film thickness.

In such a way, an electrophotographic photosensitive member having the conductive layer, the undercoat layer, the charge generation layer and the hole transport layer on the support was fabricated.

The fabricated electrophotographic photosensitive member was installed on a remodeled printer of a laser beam printer (trade name: LBP-2510) made by Canon Inc., under an environment of 23° C. and 50% RH; and the surface potential and the output image were evaluated. The evaluations in detail were as follows.

(Evaluation of the Surface Potential)

A process cartridge for a cyan color of the laser beam printer was remodeled and a potential probe (model: 6000B-8, made by Trek Japan KK) was installed at a development position; and the potential of the central part of the electrophotographic photosensitive member was measured using a surface potentiometer (model: 1344, made by Trek Japan KK). The amounts of the image exposure light were set so that the dark-part potential (Vd) became −500 V and the light-part potential (Vl) became −100 V. The amounts of light when light-part potentials were evaluated in Examples other than Example 1 and Comparative Examples used an amount of light in which the light-part potential in Example 1 became −100 V.

(Evaluation of Images)

The fabricated electrophotographic photosensitive member was installed on a process cartridge for a cyan color of the laser beam printer; the process cartridge was installed on a station of a cyan process cartridge; and images were output. At this time, the amounts of image exposure light were set so that the dark-part potential became −500 V and the light-part potential became −100 V.

First, full-color images (text images in a print ratio of 1% for each color) of 3,000 sheets were output on A4-size plain sheets of paper.

Thereafter, a solid white image (one sheet), an image for ghost evaluation (5 sheets), a solid black image (one sheet) and an image for ghost evaluation (5 sheets) in this order were continuously output.

Figure 2:
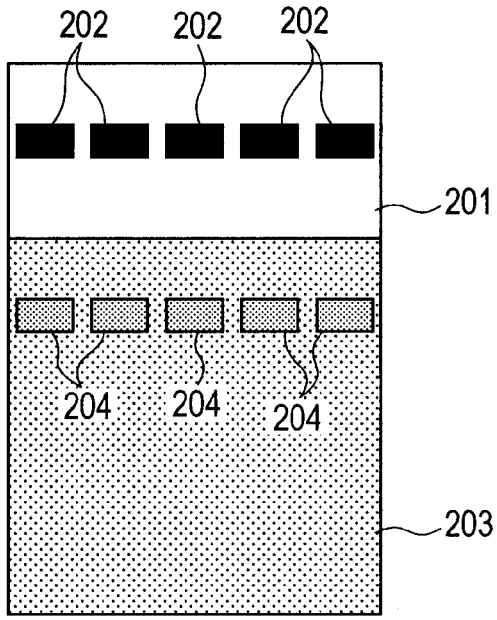
FIG. 2 is a diagram illustrating an image for ghost evaluation (print for ghost evaluation).
Figure 3:
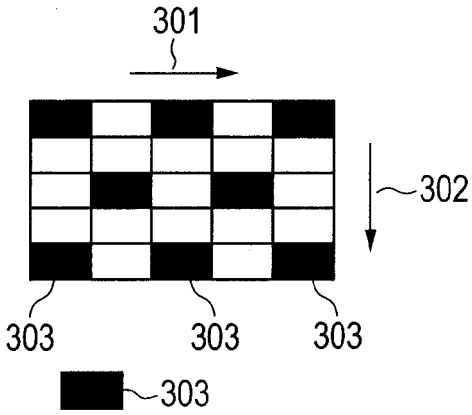
FIG. 3 is a diagram illustrating a one-dot keima (similar to knight's move) pattern image.

The image for ghost evaluation, as illustrated in FIG. 2, was one in which after square solid images 202 were output in a white image 201 on the head part of the image for ghost evaluation, a halftone image 203 of a one-dot keima (similar to knight's move) pattern as illustrated in FIG. 3 was fabricated. In FIG. 3, reference numeral 301 denotes the main scanning direction of the halftone image of the one-dot keima (similar to knight's move) pattern, and reference numeral 302 denotes the sub-scanning direction thereof. Reference numeral 303 denotes one dot.

The evaluation of the positive ghost was carried out by the measurement of differences in image density between the halftone image 203 of the one-dot keima (similar to knight's move) pattern and the ghost portion 204 (portion on which the positive ghost might be generated). Density differences of 10 points were measured in an image for ghost evaluation of one sheet by using a spectrodensitometer (trade name: X-Rite 504/508, made by X-Rite, Inc.). This operation was carried out for all of the 10 sheets of the images for ghost evaluation to calculate the average of the total of 100 points. The results are shown in Table 5-1. A higher density of the ghost portion means stronger generation of the positive ghost. The smaller density difference (Macbeth density difference) means more suppression of the positive ghost.

Examples 2 to 122

Electrophotographic photosensitive members were fabricated and evaluated as in Example 1, except for altering the polymer having a repeating structural unit (101) used in the formation of the undercoat layer in Example 1 to polymers having a repeating structural unit shown in Tables 5-1 to 5-3. The results are shown in Tables 5-1 to 5-3.

Comparative Example 1

An electrophotographic photosensitive member was fabricated and evaluated as in Example 1, except for altering the formation of an undercoat layer in Example 1, as follows. The results are shown in Table 6.

40 parts of a polyamide (Toresin EF30T, made by Nagase ChemteX Corp.) was dissolved in a mixed solvent of 300 parts of n-butanol and 500 parts of methanol to prepare a coating liquid for an undercoat layer. A conductive layer was immersion coated with the coating liquid for an undercoat layer; and the obtained coating film was dried for 10 min at 120° C. to form an undercoat layer of 0.8 μm in film thickness.

Comparative Example 2

An electrophotographic photosensitive member was fabricated and evaluated as in Example 1, except for altering the polymer having a repeating structural unit (101) used in the formation of the undercoat layer in Example 1 to a block copolymer represented by the following structural formula (17) described in a synthesis example I-2 in Japanese Patent Application Laid-Open No. 2001-83726. The results are shown in Table 6.

[Formula 10]

(17)

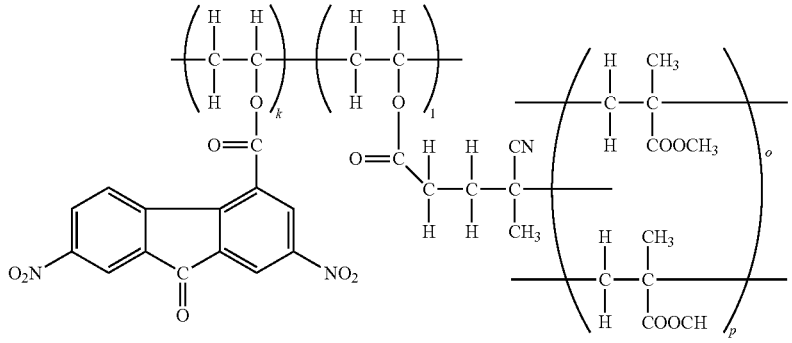

wherein k:l≅3:2; and o:p≅7:3.

Comparative Example 3

An electrophotographic photosensitive member was fabricated and evaluated as in Example 1, except for altering the polymer having a repeating structural unit (101) used in the formation of the undercoat layer in Example 1 to a polymer having a repeating structural unit represented by the following formula (18) described in Japanese Patent Application Laid-Open No. 2003-345044. The results are shown in Table 6.

[Formula 11]

(18)

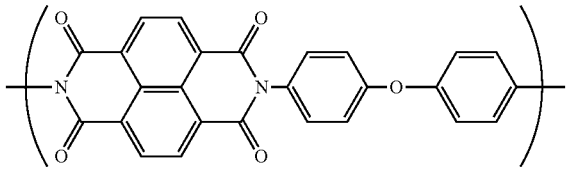

TABLE 5-1

| Example | Polymer: Repeating Structural Unit (a) | Polymer: Repeating Structural Unit (b) | Polymer: a:b (molar ratio) | Weight-Average Molecular Weight (Mw) of Polymer | Particle Diameter (μm) of Polymer Particle Before Preparation of Coating Liquid for Undercoat Layer | Particle Diameter (μm) of Polymer Particle After Preparation of Coating Liquid for Undercoat Layer | Macbeth Density Difference | Vl (−V) |
|---|---|---|---|---|---|---|---|---|
| 1 | (101) | — | — | 12000 | 5.9 | 0.31 | 0.021 | 100 |
| 2 | (102) | — | — | 15000 | 6.8 | 0.38 | 0.022 | 100 |
| 3 | (103) | — | — | 13000 | 5.3 | 0.32 | 0.044 | 105 |
| 4 | (104) | — | — | 12000 | 4.2 | 0.35 | 0.022 | 100 |
| 5 | (107) | — | — | 11000 | 5.0 | 0.36 | 0.024 | 100 |
| 6 | (110) | — | — | 9000 | 3.7 | 0.30 | 0.021 | 145 |
| 7 | (113) | — | — | 8000 | 4.8 | 0.33 | 0.021 | 140 |
| 8 | (115) | — | — | 12000 | 5.0 | 0.31 | 0.023 | 135 |
| 9 | (117) | — | — | 13000 | 5.1 | 0.30 | 0.021 | 130 |
| 10 | (120) | — | — | 10000 | 7.1 | 0.30 | 0.045 | 135 |
| 11 | (122) | — | — | 7000 | 5.3 | 0.30 | 0.022 | 130 |
| 12 | (123) | — | — | 12000 | 5.0 | 0.31 | 0.021 | 130 |
| 13 | (124) | — | — | 10000 | 3.3 | 0.38 | 0.023 | 130 |
| 14 | (131) | — | — | 14000 | 5.0 | 0.30 | 0.021 | 120 |
| 15 | (201) | — | — | 15000 | 5.0 | 0.30 | 0.027 | 100 |
| 16 | (202) | — | — | 11000 | 5.0 | 0.36 | 0.026 | 105 |
| 17 | (203) | — | — | 10000 | 6.2 | 0.35 | 0.028 | 100 |
| 18 | (204) | — | — | 7000 | 5.0 | 0.30 | 0.045 | 105 |
| 19 | (205) | — | — | 10000 | 4.4 | 0.38 | 0.026 | 100 |
| 20 | (207) | — | — | 6000 | 5.7 | 0.40 | 0.028 | 100 |
| 21 | (209) | — | — | 10000 | 6.7 | 0.35 | 0.027 | 105 |
| 22 | (210) | — | — | 7000 | 6.7 | 0.30 | 0.026 | 140 |
| 23 | (211) | — | — | 14000 | 4.4 | 0.33 | 0.027 | 145 |
| 24 | (212) | — | — | 11000 | 6.7 | 0.30 | 0.026 | 145 |
| 25 | (213) | — | — | 8000 | 5.0 | 0.31 | 0.028 | 140 |
| 26 | (214) | — | — | 14000 | 4.2 | 0.30 | 0.026 | 140 |
| 27 | (215) | — | — | 15000 | 5.5 | 0.30 | 0.026 | 135 |

TABLE 5-1-continued

| Example | Polymer: Repeating Structural Unit (a) | Polymer: Repeating Structural Unit (b) | Polymer: a:b (molar ratio) | Weight-Average Molecular Weight (Mw) of Polymer | Particle Diameter (μm) of Polymer Particle Before Preparation of Coating Liquid for Undercoat Layer | Particle Diameter (μm) of Polymer Particle After Preparation of Coating Liquid for Undercoat Layer | Macbeth Density Difference | Vl (−V) |
|---|---|---|---|---|---|---|---|---|
| 28 | (216) | — | — | 10000 | 5.0 | 0.31 | 0.026 | 130 |
| 29 | (217) | — | — | 6000 | 3.4 | 0.32 | 0.028 | 135 |
| 30 | (218) | — | — | 9000 | 5.2 | 0.35 | 0.026 | 130 |
| 31 | (219) | — | — | 8000 | 5.1 | 0.30 | 0.045 | 135 |
| 32 | (206) | — | — | 12000 | 5.0 | 0.35 | 0.027 | 105 |
| 33 | (208) | — | — | 13000 | 2.4 | 0.30 | 0.026 | 105 |
| 34 | (301) | — | — | 12000 | 5.0 | 0.30 | 0.021 | 105 |
| 35 | (303) | — | — | 10000 | 5.2 | 0.30 | 0.021 | 105 |
| 36 | (306) | — | — | 12000 | 5.0 | 0.40 | 0.023 | 105 |
| 37 | (308) | — | — | 11000 | 4.4 | 0.36 | 0.021 | 140 |
| 38 | (309) | — | — | 12000 | 4.1 | 0.31 | 0.022 | 145 |
| 39 | (311) | — | — | 15000 | 5.0 | 0.30 | 0.044 | 145 |
| 40 | (313) | — | — | 10000 | 5.0 | 0.32 | 0.021 | 145 |
| 41 | (315) | — | — | 14000 | 3.2 | 0.30 | 0.022 | 140 |
| 42 | (317) | — | — | 12000 | 6.1 | 0.30 | 0.045 | 140 |
| 43 | (318) | — | — | 10000 | 5.0 | 0.31 | 0.021 | 135 |
| 44 | (319) | — | — | 12000 | 7.1 | 0.30 | 0.021 | 130 |
| 45 | (320) | — | — | 8000 | 7.7 | 0.31 | 0.023 | 135 |
| 46 | (321) | — | — | 11000 | 6.0 | 0.38 | 0.021 | 135 |
| 47 | (322) | — | — | 10000 | 5.7 | 0.36 | 0.021 | 130 |
| 48 | (323) | — | — | 12000 | 4.1 | 0.31 | 0.022 | 130 |
| 49 | (402) | — | — | 10000 | 5.1 | 0.35 | 0.028 | 105 |
| 50 | (404) | — | — | 5000 | 5.5 | 0.35 | 0.027 | 140 |

TABLE 5-2

| Example | Polymer: Repeating Structural Unit (a) | Polymer: Repeating Structural Unit (b) | Polymer: a:b (molar ratio) | Weight-Average Molecular Weight (Mw) of Polymer | Particle Diameter (μm) of Polymer Particle Before Preparation of Coating Liquid for Undercoat Layer | Particle Diameter (μm) of Polymer Particle After Preparation of Coating Liquid for Undercoat Layer | Macbeth Density Difference | Vl (−V) |
|---|---|---|---|---|---|---|---|---|
| 51 | (406) | — | — | 15000 | 5.0 | 0.30 | 0.045 | 145 |
| 52 | (408) | — | — | 14000 | 4.4 | 0.30 | 0.026 | 140 |
| 53 | (409) | — | — | 10000 | 5.0 | 0.30 | 0.027 | 145 |
| 54 | (411) | — | — | 11000 | 2.9 | 0.32 | 0.026 | 140 |
| 55 | (412) | — | — | 8000 | 5.0 | 0.43 | 0.027 | 140 |
| 56 | (413) | — | — | 13000 | 3.4 | 0.30 | 0.026 | 130 |
| 57 | (415) | — | — | 10000 | 4.5 | 0.30 | 0.027 | 135 |
| 58 | (416) | — | — | 7000 | 5.0 | 0.35 | 0.026 | 150 |
| 59 | (417) | — | — | 11000 | 5.1 | 0.38 | 0.045 | 130 |
| 60 | (420) | — | — | 10000 | 5.0 | 0.30 | 0.026 | 135 |
| 61 | (421) | — | — | 10000 | 5.6 | 0.31 | 0.028 | 130 |
| 62 | (419) | — | — | 15000 | 4.9 | 0.31 | 0.026 | 130 |
| 63 | (502) | — | — | 7000 | 4.1 | 0.31 | 0.031 | 100 |
| 64 | (503) | — | — | 9000 | 5.0 | 0.33 | 0.044 | 140 |
| 65 | (504) | — | — | 14000 | 3.9 | 0.30 | 0.033 | 140 |
| 66 | (507) | — | — | 13000 | 5.0 | 0.35 | 0.031 | 145 |
| 67 | (510) | — | — | 12000 | 6.3 | 0.36 | 0.033 | 140 |
| 68 | (511) | — | — | 11000 | 5.0 | 0.35 | 0.031 | 140 |
| 69 | (512) | — | — | 12000 | 4.6 | 0.30 | 0.031 | 140 |
| 70 | (513) | — | — | 8000 | 6.7 | 0.30 | 0.032 | 140 |
| 71 | (514) | — | — | 10000 | 5.9 | 0.32 | 0.031 | 140 |
| 72 | (515) | — | — | 15000 | 3.7 | 0.30 | 0.045 | 135 |
| 73 | (518) | — | — | 10000 | 5.3 | 0.31 | 0.032 | 135 |
| 74 | (520) | — | — | 7000 | 4.6 | 0.30 | 0.033 | 130 |
| 75 | (521) | — | — | 14000 | 4.4 | 0.30 | 0.031 | 135 |

TABLE 5-2-continued

| Example | Polymer: Repeating Structural Unit (a) | Polymer: Repeating Structural Unit (b) | Polymer: a:b (molar ratio) | Weight-Average Molecular Weight (Mw) of Polymer | Particle Diameter (μm) of Polymer Particle Before Preparation of Coating Liquid for Undercoat Layer | Particle Diameter (μm) of Polymer Particle After Preparation of Coating Liquid for Undercoat Layer | Macbeth Density Difference | Vl (−V) |
|---|---|---|---|---|---|---|---|---|
| 76 | (522) | — | — | 10000 | 5.0 | 0.35 | 0.045 | 130 |
| 77 | (523) | — | — | 11000 | 3.2 | 0.30 | 0.031 | 130 |
| 78 | (524) | — | — | 12000 | 5.0 | 0.33 | 0.033 | 130 |
| 79 | (602) | — | — | 13000 | 6.4 | 0.42 | 0.040 | 105 |
| 80 | (604) | — | — | 10000 | 5.0 | 0.30 | 0.043 | 140 |
| 81 | (606) | — | — | 8000 | 6.8 | 0.30 | 0.040 | 150 |
| 82 | (608) | — | — | 10000 | 4.7 | 0.31 | 0.041 | 140 |
| 83 | (609) | — | — | 16000 | 5.1 | 0.30 | 0.045 | 140 |
| 84 | (610) | — | — | 15000 | 5.0 | 0.30 | 0.041 | 145 |
| 85 | (611) | — | — | 9000 | 2.9 | 0.32 | 0.042 | 145 |
| 86 | (612) | — | — | 11000 | 5.9 | 0.30 | 0.042 | 140 |
| 87 | (613) | — | — | 12000 | 5.9 | 0.30 | 0.040 | 130 |
| 88 | (614) | — | — | 13000 | 5.0 | 0.36 | 0.045 | 130 |
| 89 | (616) | — | — | 14000 | 5.0 | 0.44 | 0.040 | 135 |
| 90 | (618) | — | — | 15000 | 3.7 | 0.35 | 0.042 | 135 |
| 91 | (619) | — | — | 10000 | 6.5 | 0.30 | 0.040 | 130 |
| 92 | (621) | — | — | 10000 | 4.8 | 0.33 | 0.041 | 135 |
| 93 | (622) | — | — | 8000 | 5.0 | 0.30 | 0.043 | 130 |
| 94 | (702) | — | — | 10000 | 4.1 | 0.30 | 0.040 | 100 |
| 95 | (703) | — | — | 11000 | 5.0 | 0.33 | 0.046 | 140 |
| 96 | (706) | — | — | 12000 | 5.0 | 0.30 | 0.042 | 140 |
| 97 | (707) | — | — | 7000 | 5.7 | 0.31 | 0.040 | 140 |
| 98 | (708) | — | — | 6000 | 5.0 | 0.30 | 0.041 | 145 |
| 99 | (711) | — | — | 9000 | 5.0 | 0.30 | 0.041 | 145 |
| 100 | (714) | — | — | 10000 | 4.8 | 0.35 | 0.040 | 145 |

TABLE 5-3

| Example | Polymer: Repeating Structural Unit (a) | Polymer: Repeating Structural Unit (b) | Polymer: a:b (molar ratio) | Weight-Average Molecular Weight (Mw) of Polymer | Particle Diameter (μm) of Polymer Particle Before Preparation of Coating Liquid for Undercoat Layer | Particle Diameter (μm) of Polymer Particle After Preparation of Coating Liquid for Undercoat Layer | Macbeth Density Difference | Vl (−V) |
|---|---|---|---|---|---|---|---|---|
| 101 | (715) | — | — | 10000 | 3.4 | 0.32 | 0.040 | 135 |
| 102 | (717) | — | — | 15000 | 5.0 | 0.30 | 0.042 | 130 |
| 103 | (720) | — | — | 10000 | 3.0 | 0.30 | 0.041 | 130 |
| 104 | (723) | — | — | 13000 | 4.4 | 0.30 | 0.043 | 130 |
| 105 | (724) | — | — | 12000 | 5.0 | 0.30 | 0.040 | 130 |
| 106 | (802) | — | — | 10000 | 6.9 | 0.35 | 0.036 | 105 |
| 107 | (804) | — | — | 11000 | 5.0 | 0.37 | 0.037 | 145 |
| 108 | (806) | — | — | 14000 | 6.7 | 0.31 | 0.037 | 145 |
| 109 | (807) | — | — | 10000 | 5.6 | 0.30 | 0.036 | 140 |
| 110 | (813) | — | — | 14000 | 5.0 | 0.33 | 0.038 | 135 |
| 111 | (814) | — | — | 9000 | 3.2 | 0.30 | 0.045 | 135 |
| 112 | (816) | — | — | 16000 | 4.1 | 0.31 | 0.036 | 130 |
| 113 | (819) | — | — | 6000 | 6.8 | 0.30 | 0.037 | 130 |
| 114 | (821) | — | — | 15000 | 3.2 | 0.32 | 0.036 | 130 |
| 115 | (101) | (91) | 7:3 | 7000 | 4.9 | 0.30 | 0.021 | 125 |
| 116 | (101) | (91) | 5:5 | 8000 | 6.8 | 0.35 | 0.023 | 120 |
| 117 | (107) | (91) | 5:5 | 14000 | 4.2 | 0.37 | 0.022 | 120 |
| 118 | (101) | (92) | 7:3 | 11000 | 5.0 | 0.33 | 0.021 | 125 |
| 119 | (101) | (92) | 5:5 | 13000 | 5.2 | 0.33 | 0.022 | 125 |
| 120 | (201) | (92) | 7:3 | 15000 | 4.0 | 0.31 | 0.021 | 120 |
| 121 | (110) | (93) | 7:3 | 12000 | 3.8 | 0.40 | 0.024 | 145 |
| 122 | (115) | (94) | 7:3 | 11000 | 6.1 | 0.35 | 0.024 | 130 |

TABLE 19

| Table 6 | | |
|---|---|---|
| Comparative Example | Macbeth Density Difference | Vl (−V) |
| 1 | 0.040 | 135 |
| 2 | 0.042 | 130 |
| 3 | 0.041 | 130 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2010-147351, filed Jun. 29, 2010, and No. 2011-137511, filed on Jun. 21, 2011 which are hereby incorporated by reference herein in their entirety.

The invention claimed is:

1. An electrophotographic photosensitive member comprising an electrically conductive support, an undercoat layer formed on the support, and a photosensitive layer formed on the undercoat layer, the photosensitive layer comprising a charge generation material and a hole transport material, wherein the undercoat layer comprises a polymer having a repeating structural unit represented by the following formula (1) with the proviso that a polymer further having a repeating structural unit represented by the following formula (2) is excluded from the polymer having the repeating structural unit represented by the following formula (1):

[Formula 1]

$$\text{-}(Z^1\text{-}A^1\text{-}Z^2\text{-}W^1\text{-}B^1\text{-}W^2)\text{-} \quad (1)$$

$$\text{-}(Z^3\text{-}A^2\text{-}Z^4\text{-}W^3\text{-}B^2\text{-}W^4)\text{-} \quad (2)$$

wherein, in the formulae (1) and (2), $Z^1$ to $Z^4$ each independently represents a single bond, an alkylene group, an arylene group, an arylene group substituted with an alkyl group, or an aralkylene group; $W^1$ to $W^4$ each independently represents a single bond, a urethane bond, or a urea bond; $B^1$ represents an arylene group substituted with a carboxyl group or a sulfo group, an arylene group substituted with a carboxyl group and an alkyl group, or an alkylene group substituted with a carboxyl group or a sulfo group; $B^2$ represents an arylene group, an alkylene group, an aralkylene group, an arylene group substituted with an alkyl group, a halogen atom, a cyano group or a nitro group, an alkylene group substituted with a halogen atom, a cyano group or a nitro group, an aralkylene group substituted with an alkyl group, a halogen atom, a cyano group or a nitro group, an arylene group interrupted by ether or sulfonyl, or an alkylene group interrupted by ether; and $A^1$ and $A^2$ each independently represents a divalent group represented by any of the following formulae (A-1) to (A-8):

[Formula 2]

(A-1)

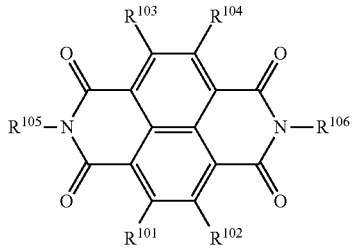

(A-2)

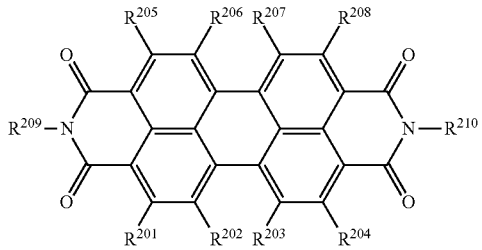

(A-3)

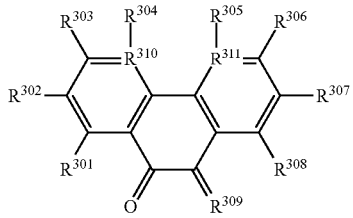

(A-4)

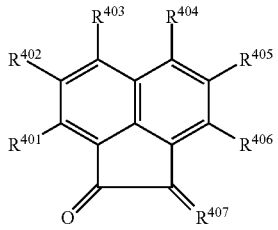

(A-5)

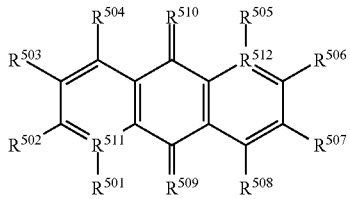

(A-6)

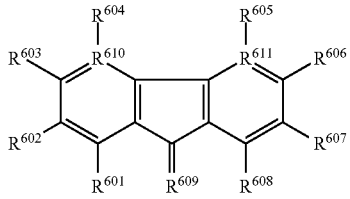

-continued (A-7)

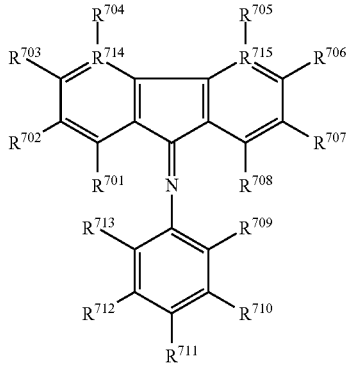

(A-8)

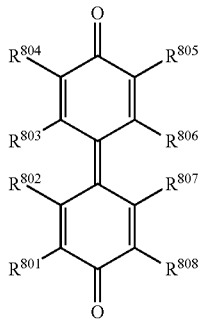

wherein, in the formula (A-1), $R^{101}$ to $R^{104}$ each independently represents a hydrogen atom, an aryl group, an aryl group substituted with a halogen atom, a nitro group, a cyano group, an alkyl group or a halogenated alkyl group, an alkyl group, a cyano group, or a bonding site; and $R^{105}$ and $R^{106}$ each independently represents an aryl group, an aryl group substituted with an alkyl group or a halogen atom, an alkyl group, or a bonding site; provided that two of $R^{101}$ to $R^{106}$ are each a bonding site;

in the formula (A-2), $R^{201}$ to $R^{208}$ independently represents a hydrogen atom, an aryl group, an aryl group substituted with a halogen atom, a nitro group, a cyano group, an alkyl group or a halogenated alkyl group, an alkyl group, a cyano group, or a bonding site; and $R^{209}$ and $R^{210}$ each independently represents a hydrogen atom, an aryl group, an aryl group substituted with an alkyl group or a halogen atom, an alkyl group, or a bonding site; provided that two of $R^{201}$ to $R^{210}$ are each a bonding site;

in the formula (A-3), $R^{301}$ to $R^{308}$ each independently represents a hydrogen atom, an aryl group, an aryl group substituted with a halogen atom, a nitro group, a cyano group, an alkyl group or a halogenated alkyl group, an alkyl group, a cyano group, a nitro group, or a bonding site; $R^{309}$ represents an oxygen atom, or a dicyanomethylene group; $R^{310}$ and $R^{311}$ each independently represents a carbon atom, or a nitrogen atom; in the case where $R^{310}$ is a nitrogen atom, $R^{304}$ is not present, and in the case where $R^{311}$ is a nitrogen atom, $R^{305}$ is not present; provided that two of $R^{301}$ to $R^{308}$ are each a bonding site;

in the formula (A-4), $R^{401}$ to $R^{406}$ independently represents a hydrogen atom, an aryl group, an aryl group substituted with a halogen atom, a nitro group, a cyano group, an alkyl group or a halogenated alkyl group, an alkyl group, a cyano group, a nitro group, or a bonding site; and $R^{407}$ represents an oxygen atom, or a dicyanomethylene group; provided that two of $R^{401}$ to $R^{406}$ are each a bonding site;

in the formula (A-5), $R^{501}$ to $R^{508}$ each independently represents a hydrogen atom, an aryl group, an aryl group substituted with a halogen atom, a nitro group, a cyano group, an alkyl group or a halogenated alkyl group, an alkyl group, a cyano group, a nitro group, or a bonding site; $R^{509}$ and $R^{510}$ each independently represents an oxygen atom, or a dicyanomethylene group; $R^{511}$ and $R^{512}$ each independently represents a carbon atom, or a nitrogen atom; in the case where $R^{511}$ is a nitrogen atom, $R^{501}$ is not present, and in the case where $R^{512}$ is a nitrogen atom, $R^{505}$ is not present; provided that two of $R^{501}$ to $R^{508}$ are each a bonding site;

in the formula (A-6), $R^{601}$ to $R^{608}$ each independently represents a hydrogen atom, an aryl group, an aryl group substituted with a halogen atom, a nitro group, a cyano group, an alkyl group or a halogenated alkyl group, an alkyl group, a cyano group, a nitro group, a carboxylate ester group, or a bonding site; $R^{610}$ and $R^{611}$ each independently represents a carbon atom, or a nitrogen atom; in the case where $R^{610}$ is a nitrogen atom, R604 is not present, and in the case where $R^{611}$ is a nitrogen atom, $R^{605}$ is not present; and R609 represents a dicyanomethylene group; provided that two of $R^{601}$ to $R^{608}$ are each a bonding site;

in the formula (A-7), $R^{701}$ to $R^{713}$ each independently represents a hydrogen atom, an aryl group, an aryl group substituted with a halogen atom, a nitro group, a cyano group, an alkyl group or a halogenated alkyl group, an alkyl group, a cyano group, a nitro group, a carboxylate ester group, or a bonding site; $R^{714}$ and $R^{715}$ each independently represents a carbon atom, or a nitrogen atom; in the case where $R^{714}$ is a nitrogen atom, $R^{704}$ is not present, and in the case where $R^{715}$ is a nitrogen atom, $R^{705}$ is not present; provided that two of $R^{701}$ to $R^{713}$ are each a bonding site; and in the formula (A-8), $R^{801}$ to $R^{808}$ each independently represents a hydrogen atom, an aryl group, an aryl group substituted with a halogen atom, a nitro group, a cyano group, an alkyl group or a halogenated alkyl group, an alkyl group, a cyano group, a nitro group, or a bonding site; provided that two of $R^{801}$ to $R^{808}$ are each a bonding site.

2. The electrophotographic photosensitive member according to claim 1, wherein the photosensitive layer comprising a charge generation material and a hole transport material is a photosensitive layer comprising a charge generation layer comprising a charge generation material and a hole transport layer comprising a hole transport material provided in this order from the support side.

3. A process cartridge which integrally supports: an electrophotographic photosensitive member according to claim 1; and at least one device selected from the group consisting of a charging device, a developing device, a transfer device and a cleaning device, the cartridge being detachably mountable to a main body of an electrophotographic apparatus.

4. An electrophotographic apparatus comprising an electrophotographic photosensitive member according to claim 1, a charging device, an exposure device, a developing device, and a transfer device.

* * * * *